US008062072B2

(12) United States Patent
Ziobro

(10) Patent No.: US 8,062,072 B2
(45) Date of Patent: Nov. 22, 2011

(54) TAMPER RESISTANT CONVENIENCE OUTLET

(76) Inventor: David J. Ziobro, Fayetteville, GA (US)

( * ) Notice: Subject to any disclaimer, the term of this patent is extended or adjusted under 35 U.S.C. 154(b) by 220 days.

(21) Appl. No.: 12/313,555

(22) Filed: Nov. 21, 2008

(65) Prior Publication Data

US 2010/0130053 A1 May 27, 2010

(51) Int. Cl.
*H01R 25/00* (2006.01)

(52) U.S. Cl. ..... 439/650

(58) Field of Classification Search ..... 439/404, 439/145, 381, 650, 137, 139, 342, 346; 174/53, 174/58, 66
See application file for complete search history.

(56) References Cited

U.S. PATENT DOCUMENTS

| | | | | |
|---|---|---|---|---|
| 4,017,137 | A | 4/1977 | Parks | |
| 4,245,880 | A | 1/1981 | Zimmerman et al. | |
| 4,379,607 | A | 4/1983 | Bowden | |
| 4,932,886 | A * | 6/1990 | Glaser | 439/137 |
| 6,142,815 | A * | 11/2000 | Whiteman et al. | 439/381 |
| 6,179,634 | B1 | 1/2001 | Hull et al. | |
| 6,441,304 | B1 * | 8/2002 | Currier et al. | 174/53 |
| 6,508,566 | B1 | 1/2003 | Roorda | |
| 6,601,977 | B2 | 8/2003 | Gesue | |
| 7,156,694 | B1 | 1/2007 | Anderson | |
| 7,394,019 | B2 | 7/2008 | Gesue | |
| 7,820,909 | B2 * | 10/2010 | Castaldo et al. | 174/53 |

OTHER PUBLICATIONS

AMP Convenience Outlet Instruction Sheet, date unknown,pp. 1-2.
Carlon Company, "Carbon Floor Boxes and Covers," catalog, Oct. 2007, pp. 13-14, Lamson and Sessions, 2007, US.
Pass & Seymour Company, "Self-contained Devices," catalog, Sep. 2005, pp. 3, 4, 6 Pass&Seymour, 2005, US.

* cited by examiner

*Primary Examiner* — Edwin A. Leon
(74) *Attorney, Agent, or Firm* — Lewinski Law Group LLC

(57) ABSTRACT

In an example embodiment a convenience outlet includes a housing, a face plate configured to receive an electrical plug, a terminal assembly within the housing, and a tamper-resistant module enclosed within the housing between the faceplate and the terminal assembly. The housing may be configured to install within an aperture of an outlet assembly housing. The housing may include a notch for engaging a protrusion on the aperture of the outlet assembly housing. The convenience outlet may be installed in a variety of different outlet assembly housings. The convenience outlet provides multiple methods to electrical connection with a power source.

19 Claims, 19 Drawing Sheets

TAMPER RESISTANT CONVENIENCE OUTLET

FIELD OF THE INVENTION

The invention relates to outlets and lighting assemblies, and more particularly to undercabinet-mounted light and power assemblies.

BACKGROUND

Electrical outlets provide power to electrical plugs of various devices. For example, wall electrical outlets installed in the walls of homes and other structures are typically adapted to receive a standard three-pronged grounded plug having hot, neutral, and ground tines. Wall outlets are typically connected to the wiring of the home and housed within an insulative housing having a faceplate adapted to receive an electrical plug. Convenience outlets have housings configured as stand alone devices, referred to as power strips, or configured for non-wall mounting, such as an under-cabinet luminaire in the floor, or, in window sill as disclosed in U.S. Pat. No. 6,601,977. Because convenience outlets are often installed in areas with less available mounting space, the housings are often smaller and more compact than those of traditional wall outlets. In addition, convenience outlets may require different wiring techniques than those traditionally employed in wiring wall outlets.

While electrical outlets are desirable because they make electrical power readily available at convenient locations, accessibility raises safety concerns, such as the possibility that a child may insert an object into the outlet and be shocked. To prevent such incidents, tamper resistant (TR) electrical wall outlets, such as that disclosed in U.S. Pat. No. 4,379,607, have been developed. TR outlets are increasingly used in new construction to comply with new building codes. In addition, there is growing interest in upgrading existing outlets with TR capability. Providing tamper-resistant capability to convenience outlets has proven difficult, however, due to the smaller housing and the wiring techniques employed in such arrangements.

Numerous desktop lamps and other electrical items in use today in homes and hotels today contain convenience outlets. As owners upgrade their electrical installations to satisfy safety codes, many owners will prefer to replace the current convenience outlet with a tamper resistant one, rather than replacing the entire desktop lamp or other electrical item. It would be desirable if this exchange could be accomplished by replacing the existing outlet with a tamper resistant convenience outlet within the desktop lamp or other electrical item without requiring modifications to the desktop lamp or other electrical item.

It is also often desirable to provide electrical power and lighting under cabinets, such as kitchen cabinets. For example, under-cabinet lighting is popular in contemporary kitchens, along with tile, granite or stainless-steel on the backsplash walls between the cabinets and the countertops. Electrical codes often require that electrical receptacles, rated for a minimum of 15 amp operation, be placed so that no spot on a kitchen counter, measured along the wall line, is more than 24" from a receptacle. Receptacles installed in the backsplash wall may interfere with the clean appearance of the back splash wall and obstruct the design thereof. Additionally, the added thickness of tile, granite, or other material complicates the installation of the receptacles in the backsplash wall.

A common solution to the dilemma of providing both power and light under-cabinet is to install a multiple outlet-strip underneath the cabinet and track or rope lighting parallel to the outlet-strip. For example, in prior art arrangements, power may be provided by outlets mounted in the backsplash of the cabinets and lights attached beneath the cabinets. Some prior art teaches outlet assemblies mounted beneath a cabinet, such as U.S. Pat. No. 7,156,694 or light assemblies mounted under cabinets, such as U.S. Pat. No. 6,508,566. While fit for their intended purposes, these prior art arrangements are difficult to install and fail to provide both convenient plug outlets and lights that can be easily installed and wired. While the end result provides lighting under the cabinets and removes the outlets from the backsplash wall, the installation is cumbersome, and labor intensive.

Alternatively, many under-cabinet light fixtures are available with a single convenience outlet incorporated in the housing. However, because the convenience outlet is powered by the same circuit as the under cabinet light itself, these convenience outlets are limited to operation at 12 amps or less; and thus the single outlet within the fixture's housing will not satisfy the code requirement as described above.

SUMMARY

TR Convenience Outlet

In an example embodiment, a TR convenience outlet is provided that is tamper-resistant, adapted for incorporation into a variety of different low profile enclosures, and compatible with a variety of wiring methods. In one example embodiment, the TR outlet may include a face plate adapted to receive an electrical plug, a terminal assembly having terminals adapted to electrically connect with an electrical plug and a power source using a variety of wiring methods, a main housing for the terminal assembly, a tamper resistant (TR) module between the faceplate and the terminals to manage electrical contact with the terminals, and a rear cover adapted to couple to the main housing. In an example embodiment, the face plate may include a housing for receiving and positioning the TR module between the apertures of the face plate and the terminals of the terminal assembly.

The terminals of the terminal assembly may be configured to establish electrical connection with an electrical plug inserted through the face plate. In one example embodiment, first ends of the terminals have folded plate portions arranged for contacting the tines of an electrical plug inserted through the faceplate. The terminals may also be configured for wiring to a power source using a variety of different methods, such as by spade connector connection, insulation displacement connection (IDC), and pigtail connection. In one example embodiment, a terminal may include plates having v-shaped slots for displacing the insulative cover of conductors extending through notches in the main housing to establish an IDC connection, curved portions at the edges of the plates that are adapted to receive spade connectors, and a pig tail connector adapted to establish a pigtail connection.

In an example embodiment, the TR module may be a layered device having movable slides that are actuable between a default closed position in which the slides cover the terminals and prevent electrical contact therewith, and an open position in which the slides expose the terminals for electrical contact with an electrical plug. In one example embodiment, the TR module includes major and minor slides that are movably coupled and positioned within a housing of the faceplate. The faceplate and main housing may be configured for coupling with the TR module therebetween so that an object inserted through an aperture in the faceplate must extend through the TR module to contact a terminal. In one embodiment the main housing may include extensions for extending into the receiving space at the rear of the face plate and a lip for engaging a flange on the rear of the faceplate so that the TR outlet is of a sufficiently small size for use in low profile housings. In one example embodiment, the TR module may be inserted into the housing of the faceplate and the faceplate and main housing are subsequently sonically welded together to capture the shutter assembly. The TR outlet may then be incorporated into a housing assembly. The face plate, TR module, main housing, terminal assembly, and rear cover may be configured to provide a TR outlet of an overall size that can be easily incorporated into a new or existing convenience outlet housing.

Under-Cabinet Plug-Light Assembly

In an example embodiment, the TR outlet may be installed in a housing in conjunction with a light arrangement. In one example embodiment, an arrangement for providing both light and outlet or plug arrangement is adapted for mounting beneath a cabinet. In one example embodiment, a plug-light assembly comprises a light assembly that is releasably engageable with an outlet assembly. The outlet plug assembly may include a plurality of convenience outlets electrically connected prior to mounting of the housing prewired with internal wiring. The light assembly may include a plurality of lights and be prewired with internal wiring.

The outlet assembly, also referred to as a plug assembly, may include a housing having a generally horizontal upper base wall configured for mounting to the bottom of a cabinet, an angled front wall extending downward and inward from a front end of the base wall, a generally vertical rear wall extending downward from a rear end of the base wall, and front and rear bottom walls, extending inward from the bottom end of the and rear wall. The space between the bottom walls may define a receiving area through which the light assembly may be inserted and coupled to the outlet assembly. The front wall of the outlet plug assembly may include apertures through which a plurality of convenience outlets are mounted. A plurality of horizontally spaced electrical outlets maybe positioned in the angularly disposed outer wall member.

The lighting assembly may include a housing, wiring, spaced-apart sockets, and bulbs. The lighting assembly may contain low voltage electrical leads to provide power to low voltage lights remote from the outlets of the outlet assembly. The light assembly housing may comprise a generally horizontal base wall, and front and rear walls that extend downward and outward from the ends of the base wall. The light assembly housing may be configured to snap-fit together with the plug housing. In an example embodiment, the light housing is installed through the receiving area of the outlet assembly.

When the light assembly is installed in the outlet housing, the space between the front wall, base and lower wall of the outlet housing and the front wall and lower wall of the housing of the light assembly may define a front trough or raceway for the routing of wires between the outlets. For example, an IDC connection may be made between outlets installed in the plug assembly, and the wires routed through the front trough. The space between the rear wall of the lighting housing and the rear and bottom rear wall of the plug housing define a rear wiring trough or raceway. The space between the base of the light assembly housing and the base of the outlet assembly housing may define a path to allow wiring to extend between the front and rear troughs if desired.

The light housing may have releasable locking means for releasably engaging the housing of the outlet assembly. In one example embodiment, the ends of the front and rear walls of the light assembly housing may be snap-fitted to the front and rear bottom walls of the outlet housing. For example, flanges or shoulders on the ends of the light housing front and rear walls may engage recesses or lips on the front and rear bottom walls of the plug housing. This may allow the light assembly to be coupled at one end and then swung into a locking position. The light assembly may be pivoted from the outlet assembly to allow for the convenient wiring of the light assembly.

Apertures may be provided in the rear wall and in the end plates of the outlet housing to allow entry of external wiring into the interior of the housing and connection of the external wires with the internal wires of the outlets. The apertures and rear trough may also be used to allow entry and connection of the external wiring to the internal wiring of the light assembly. For example, external wires may be pulled through a rear aperture into the rear trough which provides space to electrically connect the external wires to internal wires of the outlets of the outlet assembly.

In one method of installation, convenience outlets may be installed in the receiving holes of the front wall of the plug housing and electrically connected using an internal wiring. For example, as discussed above, an IDC connection may be used to interconnect the convenience outlets and the ends of the wires placed in the rear trough for later connection with the external wiring. The ends of the internal wires may then be connected to the ends of the external wires in the rear trough. The internal wires may be extended over the light assembly in the passageway defined between the base of the light housing and the base of the plug housing. The internal wires of the light assembly may extend out the end of the light assembly and be routed to the rear wire trough for connection with external low voltage wiring.

The wiring at the rear trough is easily accessible through the receiving area of the plug housing prior to installation of the light assembly. In addition, an installer can partially install the light assembly into the plug housing and access the external wiring to electrically connect the internal wiring of the light assembly. The light assembly can then be swung into the installed position.

End caps may be positioned over the ends of the outlet housing. Apertures or knockouts may be provided in the end caps to allow the extension of wiring between adjacent outlet assembly housings if desired. The knockouts in the end caps allow a strain relief to be added in the field to secure the incoming wires to the housing via a screw or other mechanical fastener. For example, the strain relief may be configured to resist a 25-pound pull test. The knockouts may also be removed and a bushing inserted in the remaining hole to allow wiring to be routed between plug-light assemblies. For example, the outlet wiring may be routed through a first opening and the light wiring through a second opening.

Knockouts may be provided in the rear wall of the plug housing for entry of external wires that may be electrically connected with the internal wiring of the plug assembly and/or the light assembly. For example, multiple rear apertures may be provided to allow the outlet assembly and light assembly to be wired separately. For example, the plug-light may be configured with one circuit to power the outlets and a second circuit to power the lights of the light assembly. In one example embodiment, external wires from a first circuit may be electrically connected to the internal wires of the outlet assembly, and external wires from a second circuit may be electrically connected to the internal wires of the light assembly. This allows the receptacles to deliver the current required to meet electrical codes, without being affected by the current needed to power the lights. The lights may be manipulated, such as turning on/off or dimmed without affecting the power to the outlets. Power can be fed at either end of the housing through the front trough and end caps or through apertures in the rear of the housing. Loose wire from the outlets may be routed through one or both ends of the housing through the end caps as the wiring is routed along the front trough. The installer can cut the wires to an appropriate length for connection with external wiring. The enclosure may be configured to allow wiring to extend from a rear of the enclosure to each outlet.

In one example embodiment, the front wall of the outlet housing is angled and the convenience outlets installed at an angle to allow easy access when the assembly is mounted under a cabinet. The outlet assembly may include orientation means to ensure a desired orientation of the outlets installed in the outlet assembly. For example, a protrusion may be provided in the mounting apertures of the front wall of the outlet housing for mating with a notch or recess in an outlet housing of the outlet when the outlet is oriented in a proper position.

The plug-light assembly may also be configured to allow for the adjustment of the length of the assembly in the field. For example, the plug light assembly may also be shortened to a desired length by trimming the outlet and light assembly and associated wiring if needed. Thus, a particular counter or cabinet configuration can be customized. The wires for the outlets could be cut and capped at an end opposite of feed wires. The plug-light assembly may also be coupled to other assemblies to form an assembly of a desired length. For example, an end cap at an end of the plug-light assembly may be removed and replaced with a coupling section to allow the ends of adjacent plug-light assemblies to be coupled together. The internal wiring for the outlets of a first outlet assembly may then be connected to the internal wires of the adjacent assembly. Similarly, the internal wiring of the first light assembly may be electrically connected to the internal wiring of the adjacent assembly. Furthermore, the light assembly housing may be made of aluminum or steel, or made of plastic to eliminate the need to ground the light assembly housing. The plug light assembly may also be expanded to a desired length by coupling one assembly with another. For example, an end cap may be removed and replaced with a coupling section to couple adjacent ends of a housing.

A variety of different light sources may be used such as light emitting diodes (LED), incandescent, halogen, or fluorescent and powered with line or low voltage power. If a low voltage light source is used, the transformer, ballast (for fluorescent lamps), or the driver (for DC LED lamps) may be incorporated inside of the housing or mounted in a remote location, such as within the kitchen cabinet. A diffuser lens may be provided. The LED assembly or other light source can be easily replaced by simply replacing the light assembly and eliminating the need to replace and re-wire the outlet assembly.

An attaching means, such as an adhesive, may be provided atop the plug-light assembly to allow the assembly to be adhered to the underside of the cabinet to position the assembly for attachment with mechanical fasteners such as screws.

Slots may be provided in the outlet housing of the outlet assembly and configured to receive a blade of a flat-headed screwdriver to pry the housing of the light assembly from the housing of the outlet assembly. The slots also allow for air circulation to cool the light assembly and extend component life. In alternate embodiments, additional apertures may be provided.

A plurality of brackets may be provided to position the light assembly within the outlet assembly. The brackets may be formed from a punch out of the base of the outlet housing to provide an aperture to allow for airflow within the plug-light assembly.

DETAILED DESCRIPTION

Figure 1:
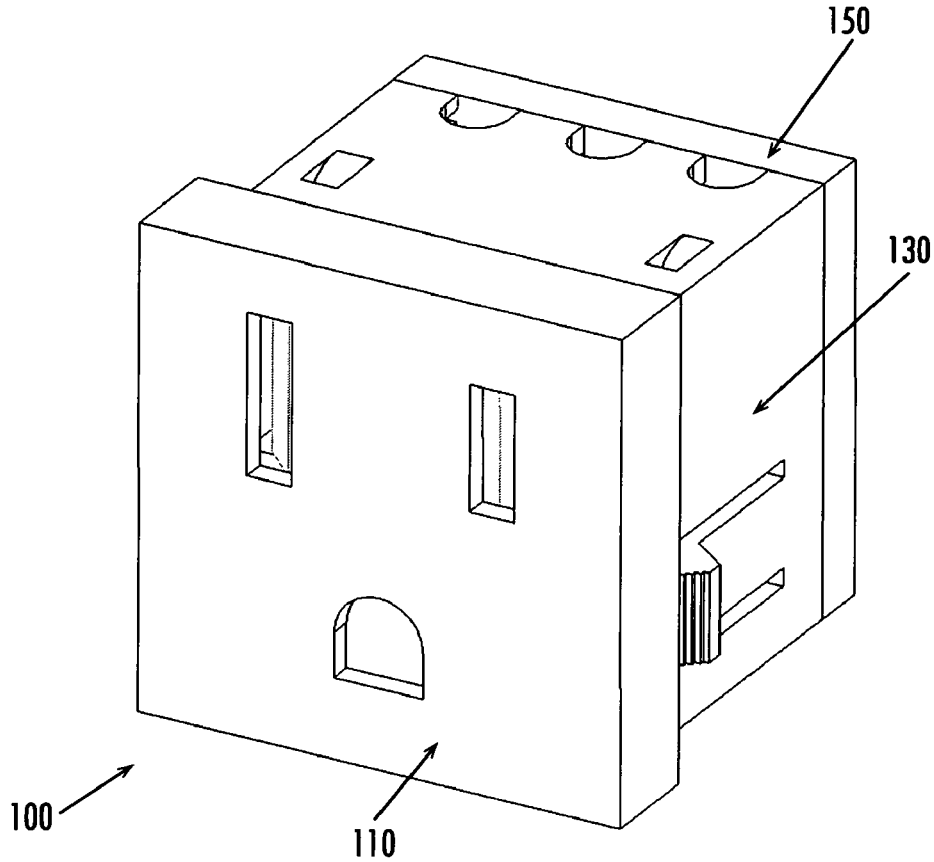
FIG. 1 shows a top front isometric view of an example embodiment of a tamper resistant convenience outlet.
Figure 2:
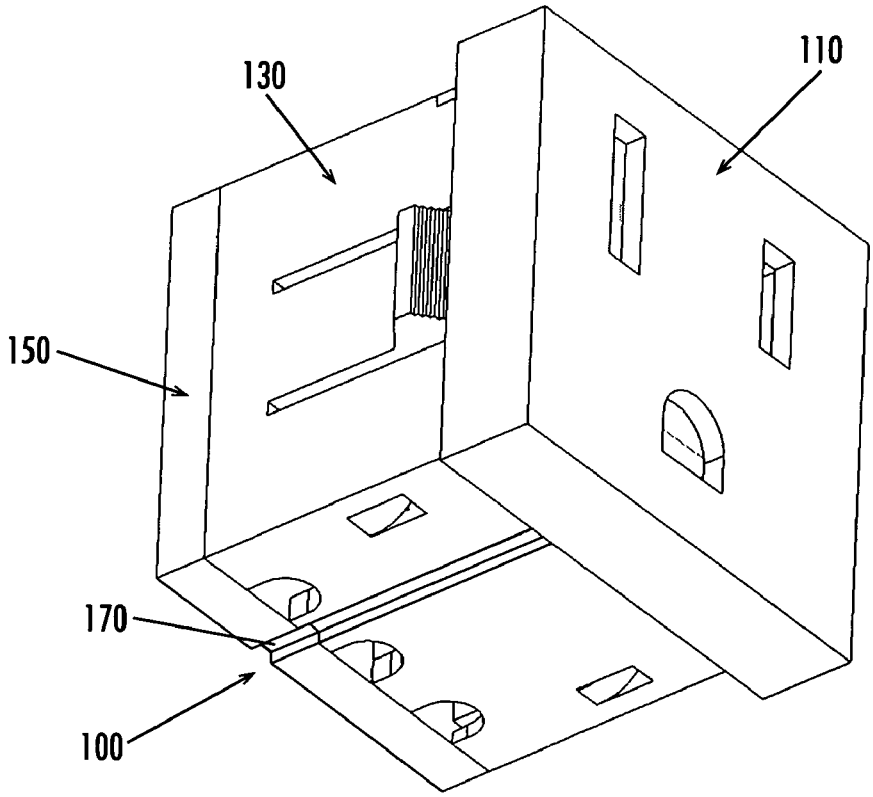
FIG. 2 shows a bottom front isometric view of an example embodiment of a tamper resistant convenience outlet.
Figure 3:
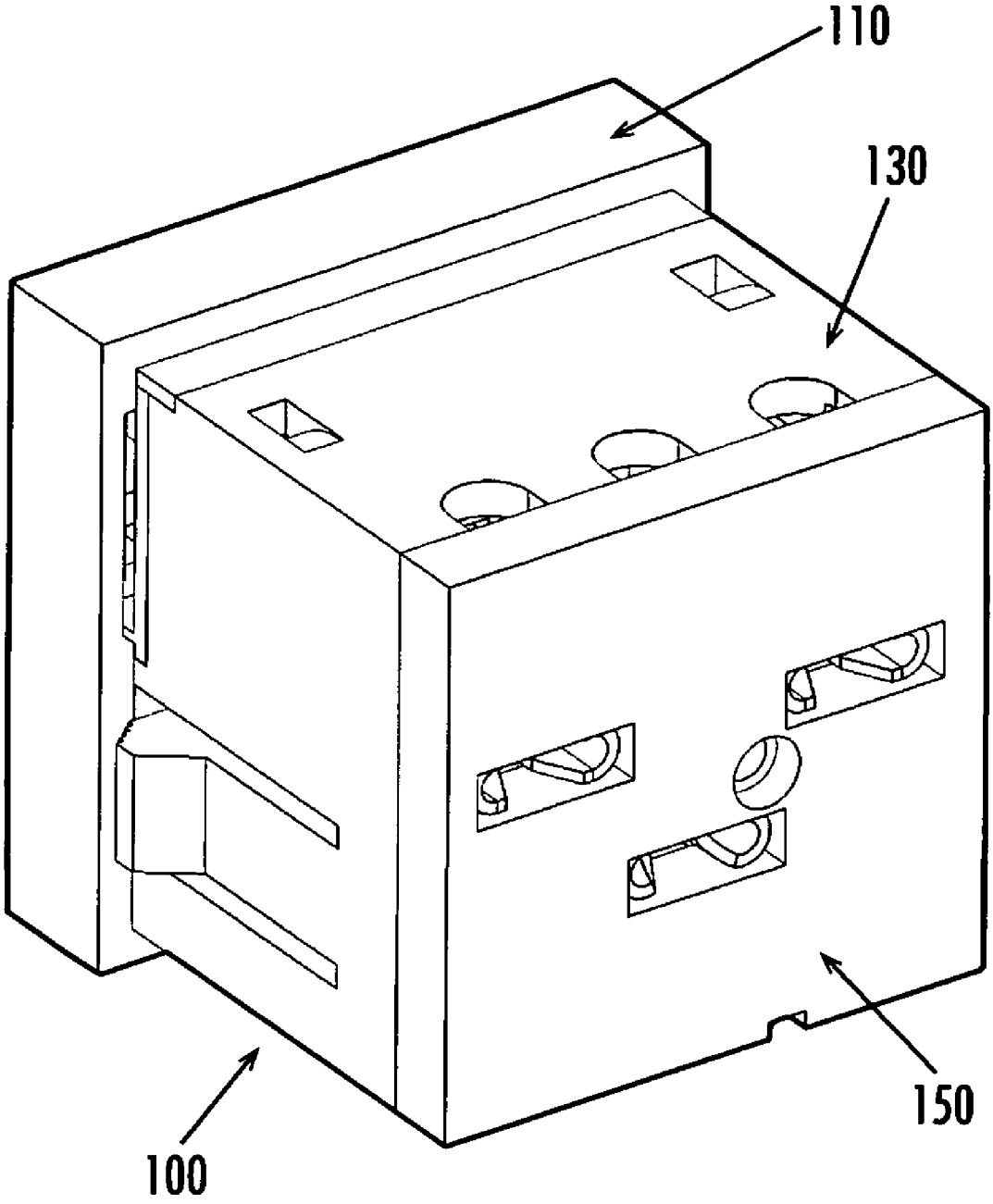
FIG. 3 shows a top rear isometric view of an example embodiment of a tamper resistant convenience outlet.

As required, exemplary embodiments of the present invention are disclosed. The various embodiments are meant to be non-limiting examples of various ways of implementing the invention and it will be understood that the invention may be embodied in alternative forms. The figures are not to scale and some features may be exaggerated or minimized to show details of particular elements, while related elements may have been eliminated to prevent obscuring novel aspects. Therefore, specific structural and functional details disclosed herein should not be interpreted as limiting, but merely as a basis for the claims and as a representative basis for teaching one skilled in the art to variously employ the present invention. While the exemplary embodiments are discussed in the context of a tamper resistant convenience outlet for mounting under a cabinet, it will be understood that the present invention is not limited to under cabinet mounts.

Turning to the figures wherein like numerals represent like features throughout the several views, FIGS. 1-5 show an exemplary embodiment of a TR convenience outlet 100. As best seen in the exploded views of FIGS. 4 and 5, the TR convenience outlet 100 may include a face plate 110, a tamper resistant (TR) module 120, a main housing 130, a terminal assembly 140, and a rear cover 150. The face plate 110, TR module 120, main housing 130, and rear cover 150, may be made of insulative material, such as a thermoset or thermoplastic.

Figure 6:
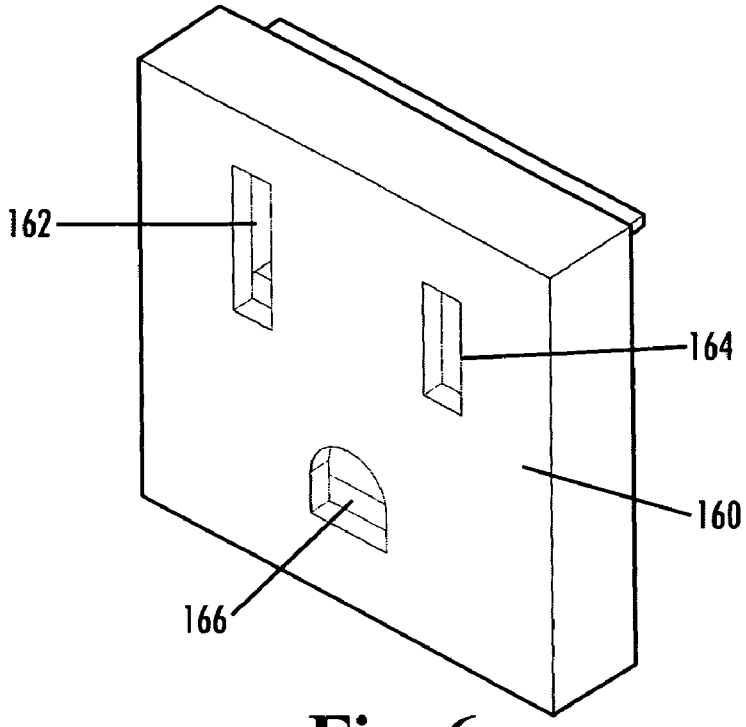
FIG. 6 shows a front view of an example embodiment of a face plate.
Figure 7:
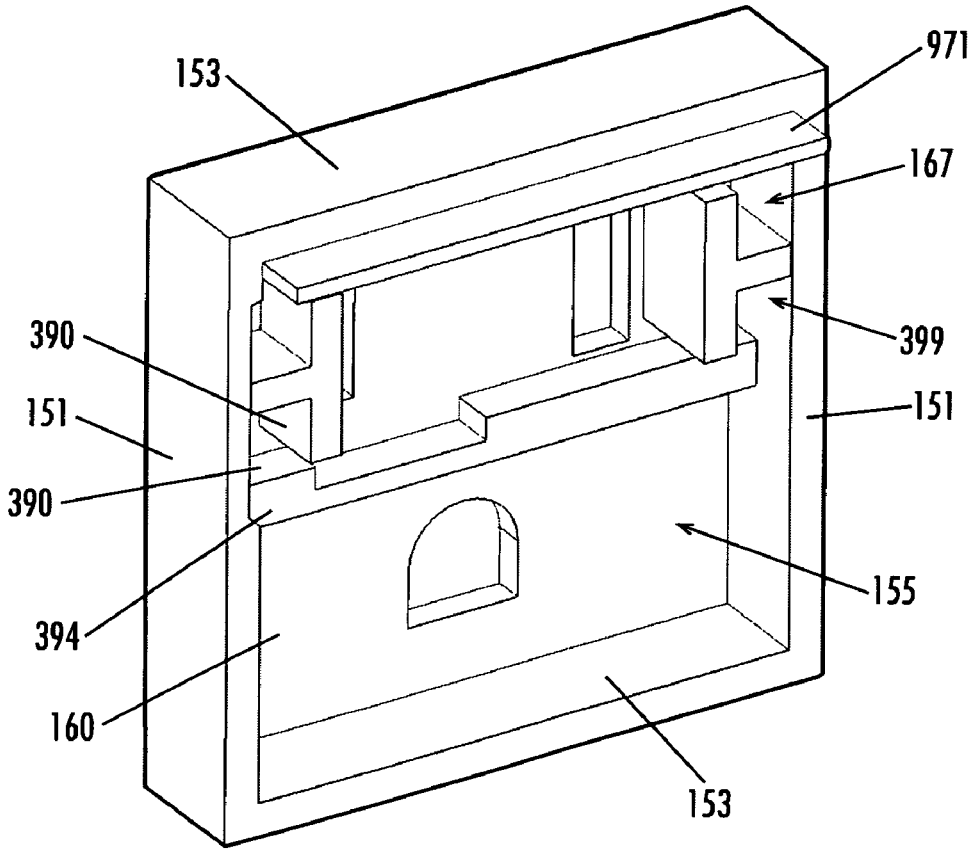
FIG. 7 shows a rear view of an example embodiment of a face plate.

As shown in FIGS. 6 and 7, the face plate 110 may include a generally planar body 160 having first 162 and second 164 power apertures adapted to receive the conductor tines 182, 184, of an electrical plug 190 (FIG. 4), and a ground aperture 166 for receiving a ground tine 186 of the plug 190. Opposing sidewalls 151 and end walls 153 rearwardly extend from the body 160. The space between the sidewalls 151 and endwalls 153 may define an interior space 155. As described in more detail below, the face plate 110 may also include a housing 167 within the interior receiving space 155 for holding a TR module 120 to provide tamper resistant functionality to the TR outlet 100.

Figure 4:
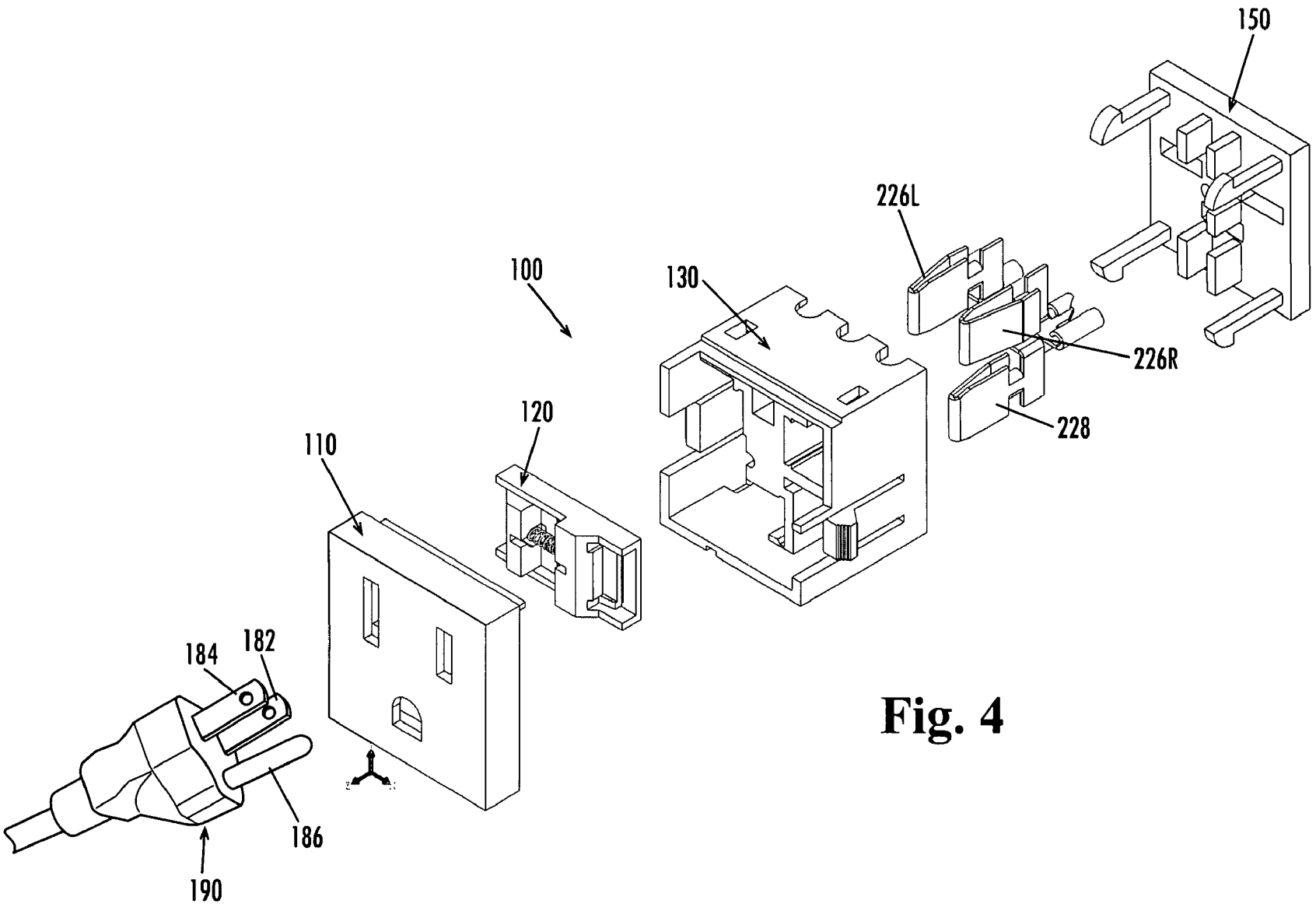
FIG. 4 shows an exploded view of an example embodiment of a tamper resistant convenience outlet.
Figure 9:
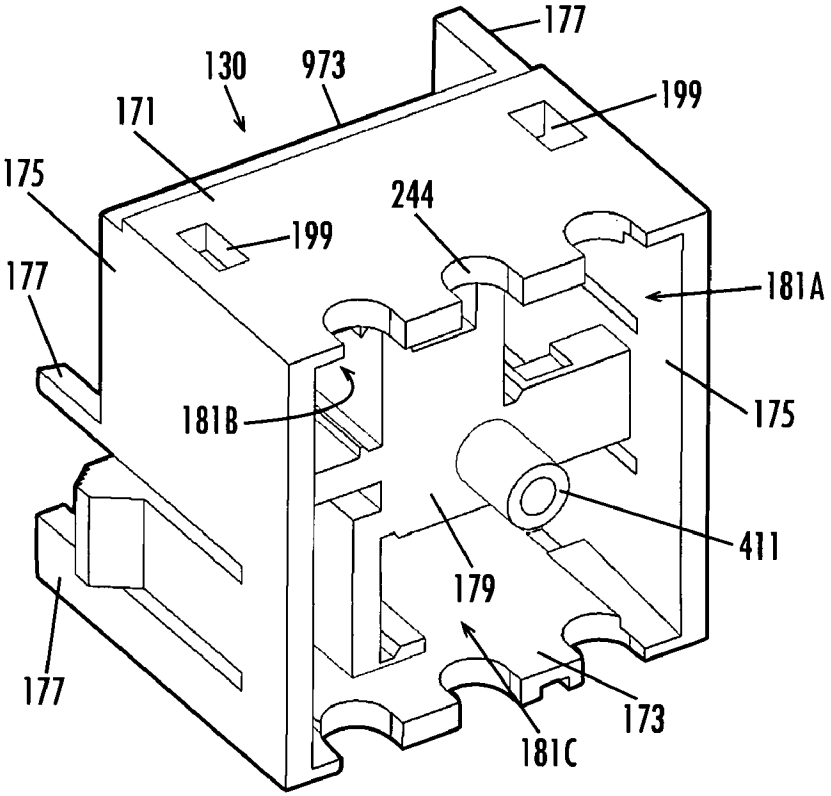
FIG. 9 shows an example embodiment of a main housing of a TR outlet.
Figure 8:
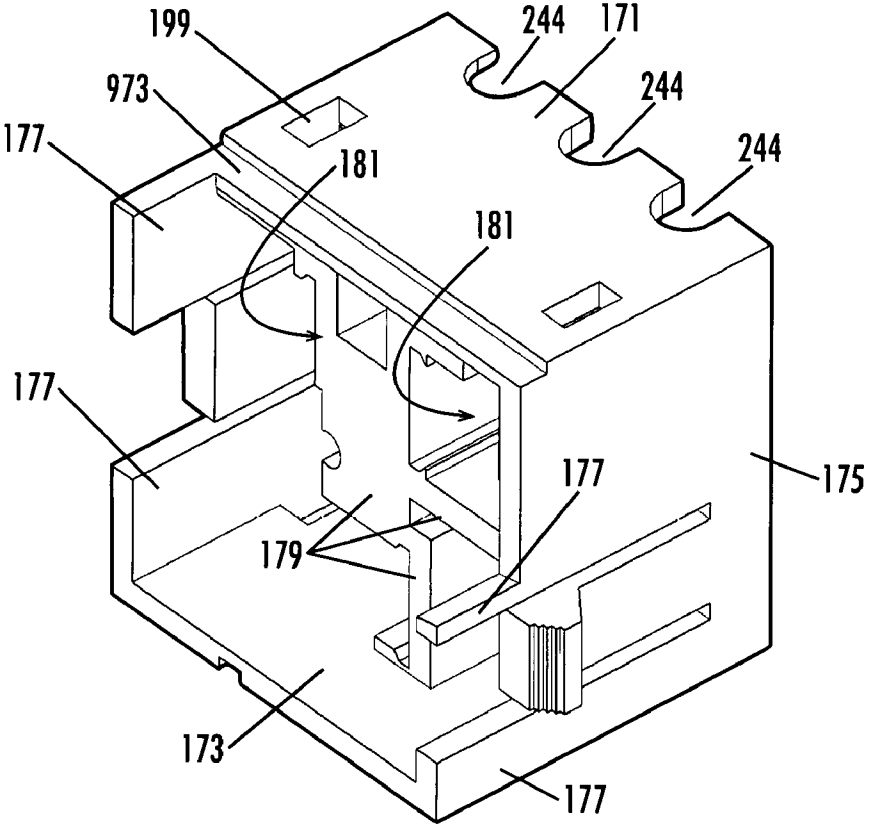
FIG. 8 shows an example embodiment of a main housing of a TR outlet.

As shown in FIG. 8 and 9, the main housing 130 may be adapted for engagement with the faceplate 110 and may include a top 171, bottom 173 and sides 175 having extending portions 177 for extending into the receiving area 155 of the faceplate 110 when the TR outlet 100 is assembled. A plurality of partitions 179 may be provided within the interior of the main housing 130 that and arranged to define terminal cavities 181 for housing the terminals 226L, 226R, 226G of the terminal assembly 140. For convenience, reference letters L, R, and G may be used to identify a specific structure where multiple similar structures are shown. In the example embodiments L, R, and G, correspond to left, right, and ground identifiers in relation to the view of FIG. 1. For example, the reference number 226 may be used to refer to a terminal generally whereas 226L may be used to refer to a terminal which corresponds to the left terminal as shown in FIG. 4. The main housing 130 may be configured to engage the faceplate 110 and may include notches 244 to allow conductors 228 to extend through the TR outlet 100 as described in more detail below. As explained in more detail below, the terminals 226 may be adapted to establish electrical contact with a plug 190 inserted through the faceplate 110 and adapted for wiring to a power source and ground.

A rear cover 150 (FIG. 10) may be provided to engage and cover the rear of the main housing 130. In an example embodiment, the rear cover 150 has legs 252 that have lugs 256 adapted to lockingly engage slots 199 in the top 171 and bottom 173 of the main housing 130. Spacers 263 may also be provided. The rear cover 150 may also include apertures 181 for receiving connectors, such as spade connectors therethrough to engage the terminals 226 as described in more detail below.

The TR module 120 may be positioned between the faceplate 110 and the terminals 226 in the main housing 110. The TR module 120 may be configured so that when a plug 190 is inserted into the face plate 110, the plug's tines 182, 184 engage the TR module 120, and, as described in more detail below, convert the TR module 120 from a default closed position, which prevents an object from extending through the TR module 120 and establishing an electrical connection with the terminals 226L, 226R, to an open position that allows the tines 182, 184 to pass through the TR module 120 and establish an electrical connection with the terminals 226L, 226R. To prevent an unwanted electrical connection of a foreign object inserted through only one of the apertures 162, 164 of the face plate 110, the TR module 120 may be configured to move to an open condition only when an object is inserted through both power apertures 152, 154 of the faceplate 110. The specific workings of the TR module 120 will be described in more detail below.

Figure 11:
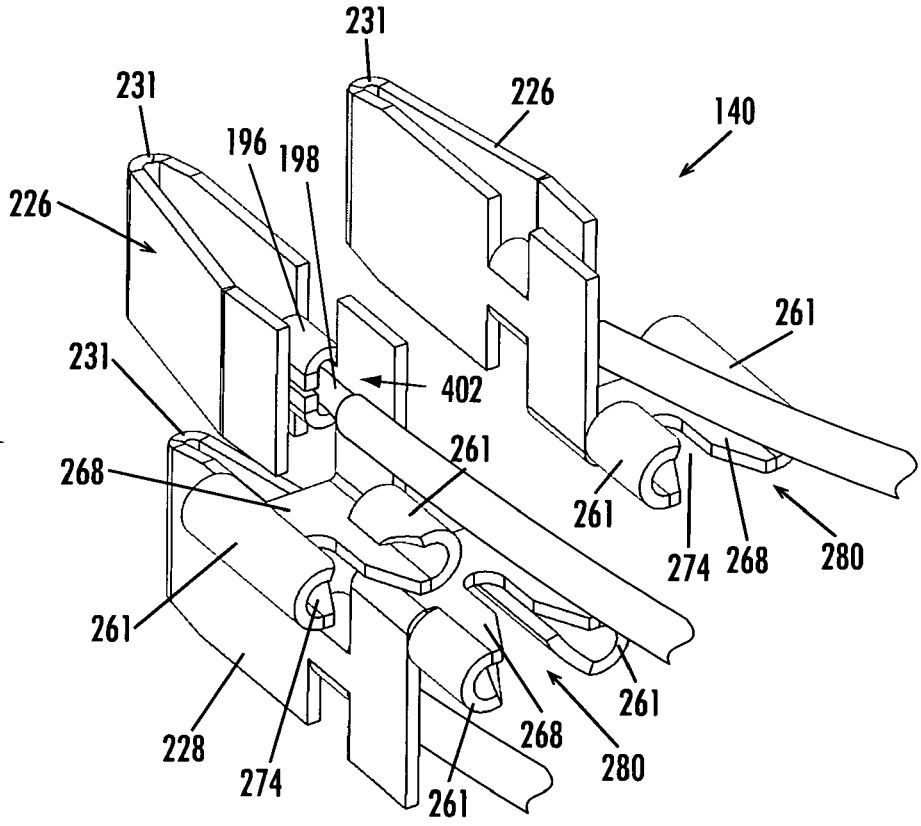
FIG. 11 shows an example embodiment of a terminal assembly of a TR outlet.
Figure 12:
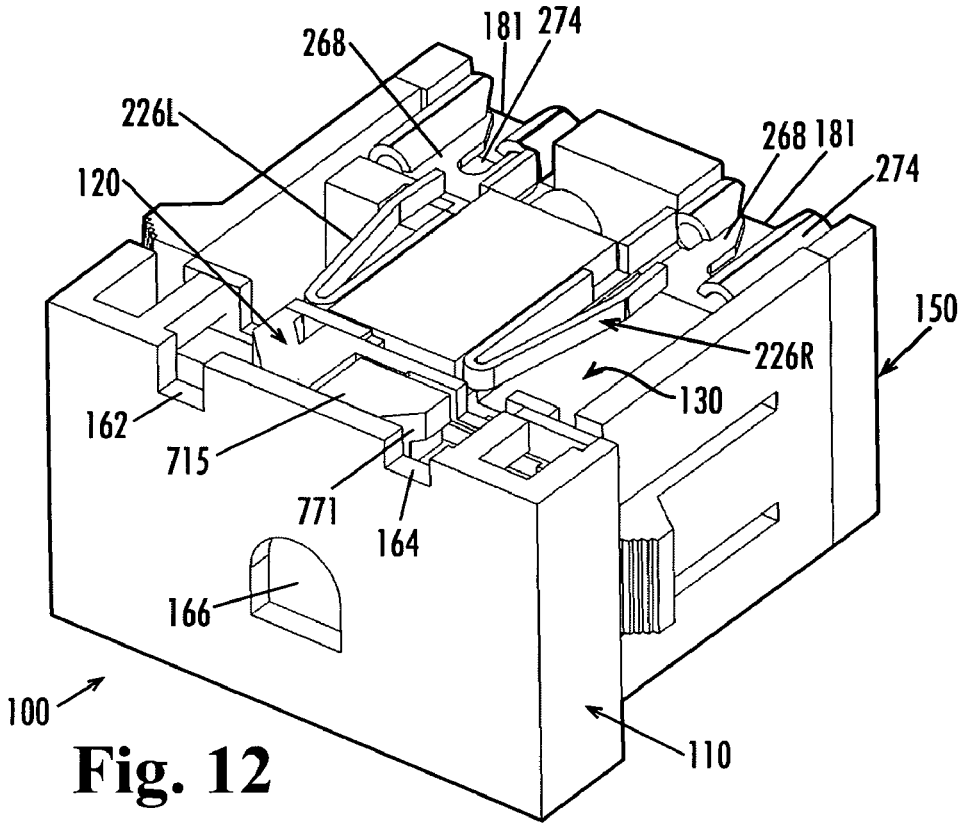
FIG. 12 shows an example embodiment of a cutaway view of the TR outlet along lines 12-12 of FIG. 1.

As best seen in FIGS. 4 and 11, the terminal assembly 140 may comprise power terminals 226L,R adapted to establish an electrical connection with a plug 190 inserted into the faceplate 110. In an example embodiment, the terminal assembly 140 may include two power terminals, 226L, 226R and a ground terminal 226G which may be housed in individual terminal cavities 181 of the main housing 130. The terminals 226 may be positioned in the main housing 130 so that one end of the terminal 226L,R,G is adapted to engage tines 182, 184, 186 of a plug 190 inserted through the face plate 110. As seen in FIG. 11, in an example embodiment, the terminals 226 may have a folded plate 231 at a front end that are located in registration with the apertures 162, 164, 166 in the face plate 110 (FIG. 12) to establish contact with a tine 182, 184 of a plug 190 extending through the faceplate 110.

Figure 13:
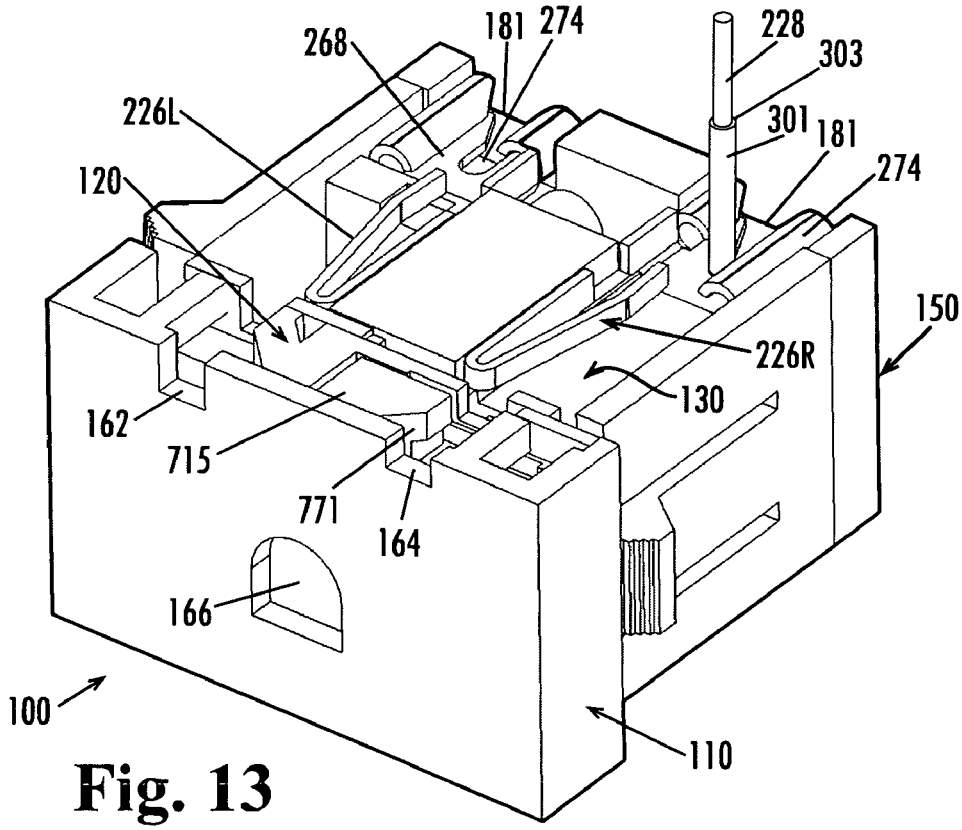
FIG. 13 shows an example embodiment of a cutaway view of a TR outlet showing an IDC connection.
Figure 14:
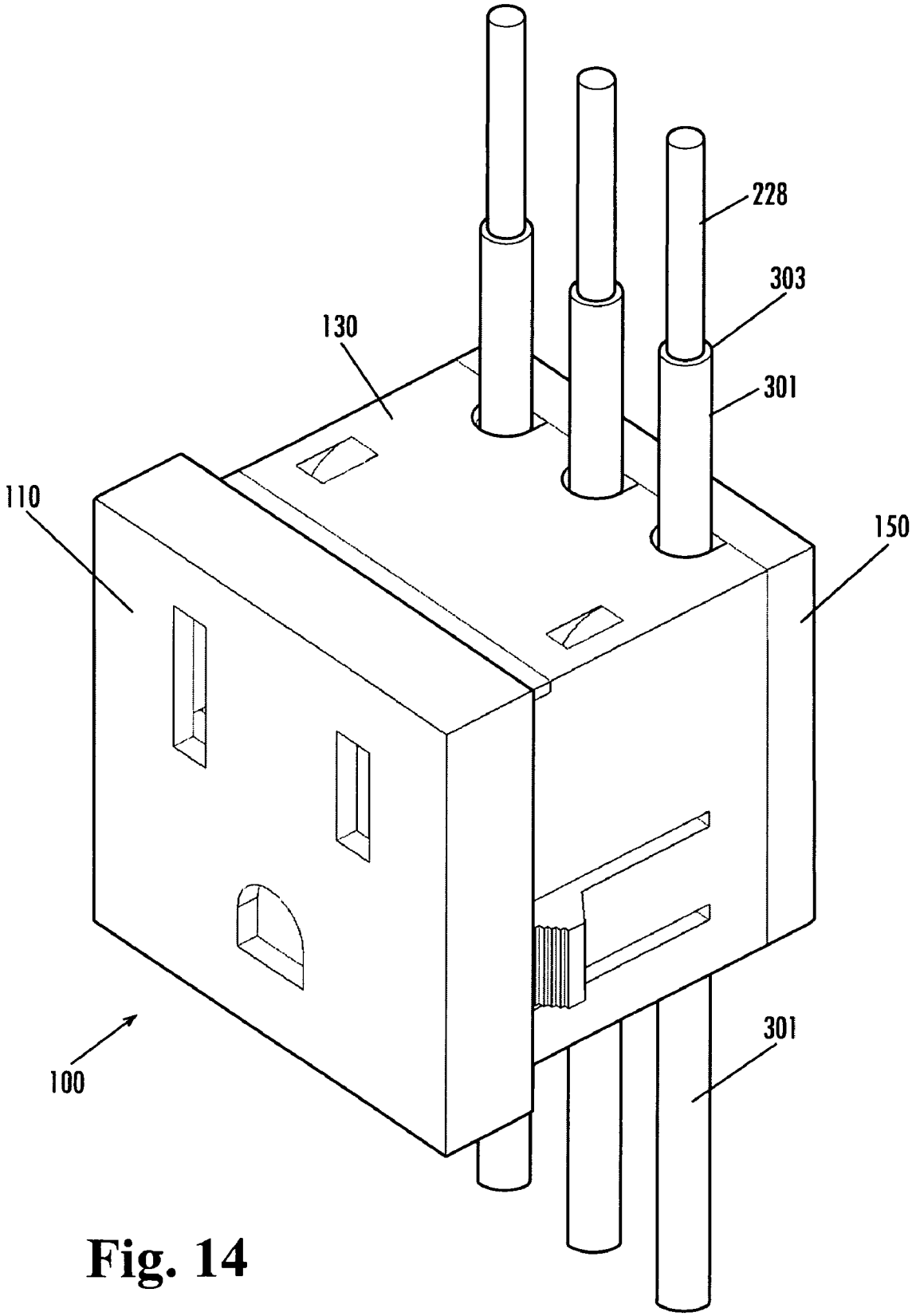
FIG. 14 shows an example embodiment of a TR outlet showing an IDC connection.

Each terminal 226 may include means for wiring the TR outlet 100 to a power source. In an example embodiment, the terminals 226 may be adapted for a spade connection, an IDC connection, and a pigtail connection. For example, the terminals 226 may include generally planar plate portions 268 with conductor engaging slots 274 for receiving and establishing an electrical connection with an insulated conductor. For example, conductors 301 may pass through the notches 244 of the main housing 130 where they are engaged by the engaging slots 274 of the terminals 226 to displace their outer insulation 303 and establish an electrical connection between the terminals 226 and the conductors 301 (FIGS. 13 and 14). Curved sidewalls 261 of the plate portions 268 may define receptacles 280 adapted to receive and establish an electrical connection with spade connectors or other terminals of a conductor. The terminals 226 may also include pigtail connectors 196 for establishing electrical connection with pigtail conductors 723 that may be incorporated into the convenience outlet 100 during manufacturing.

The terminals 226, 228 are thus adapted to allow the TR convenience outlet 100 to be wired in a variety of ways. For example, as shown in FIGS. 13 and 14, an IDC connection may be used to wire a TR convenience outlet 100 and electrically interconnect one or more convenience outlets 100 in a housing assembly. The plates 268 of the terminals 226, 228 may extend outward beyond the partitions 179 so that the angled slots 274 of the terminals 226, 228 are positioned to engage conductors 301 extending through the notches 244 (FIG. 8) in the top 171 and bottom 173 of the main housing 130. The insulated conductors 301 may be placed into the appropriate notches 244 of the main housing 130 and terminated in known fashion by forcing the conductors 301 into the appropriate slots 274 of the respective terminals 226. This can be done either without the rear cover 150 by directly pushing against the conductors 301 or with the rear cover 150 engaging and driving the conductors 301 into the slots 274. The rear cover 150 closes the rear of the convenience outlet 100 and may also act as a strain relief to prevent the unintended withdrawal of the conductors 301 from the outlet 100. For example, the lugs 256, of the legs 252 may lockingly engage slots 199 in the top 171 and bottom 173 of the main housing 130 to secure the rear cover 150 to the main housing 130.

Figure 15:
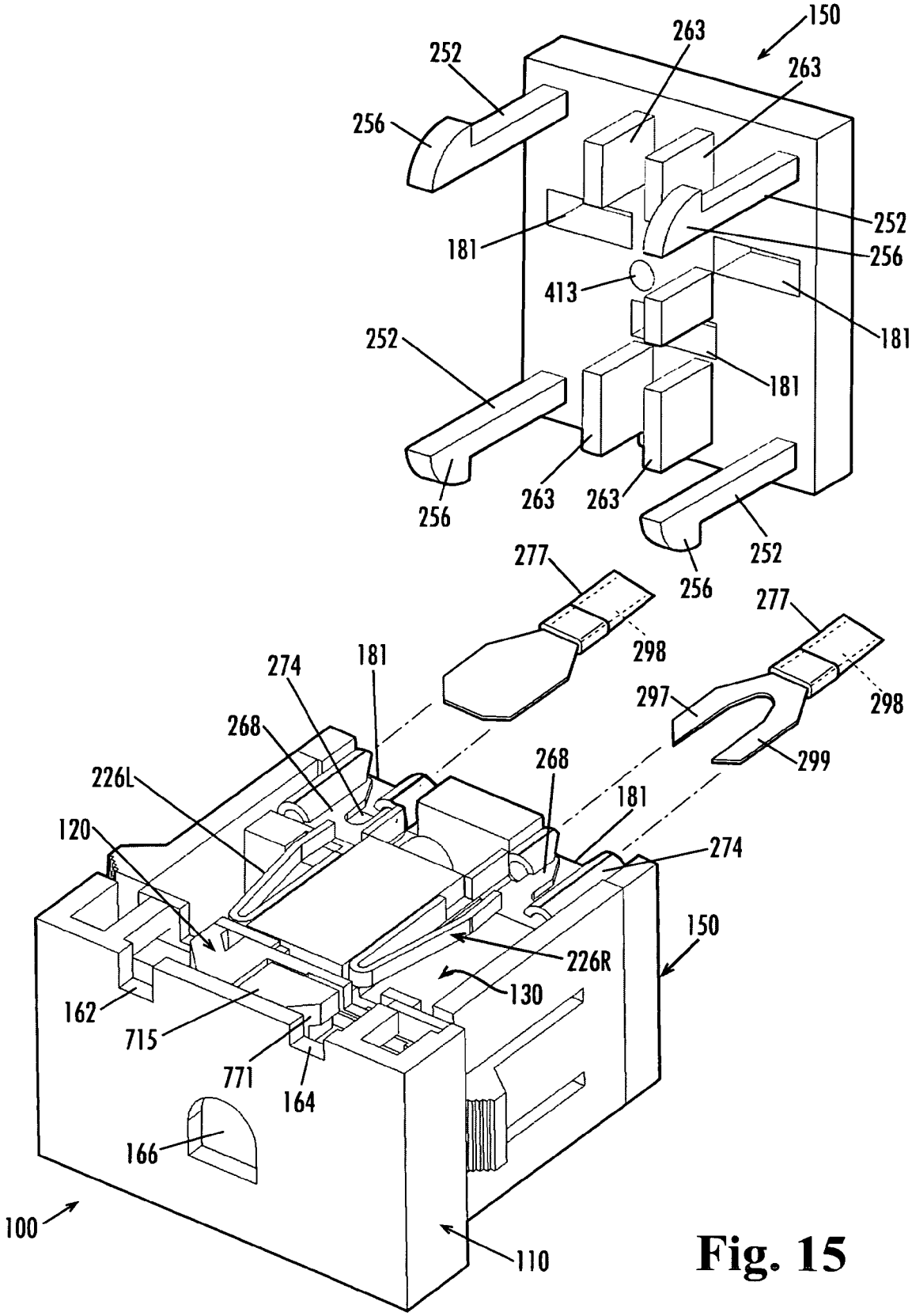
FIG. 15 shows an example embodiment of a cutaway view of a TR outlet showing a spade connection.

A TR convenience outlet 100 may also be adapted for wiring by spade connection. For example, FIG. 15 shows spade connectors 297 crimped onto a conductor 298 of a power cord 277 which in turn may be wired to a power source (not shown). The spade connector receptacles 280 of the terminals 226 may be positioned in registration with the apertures 181 in the rear cover 150 so that tines 299 of the spade connectors 297 may be inserted through the apertures 181 in the rear of the rear cover 150 to engage the spade receptacle terminals 280 and establish an electrical connection therewith.

Figure 16:
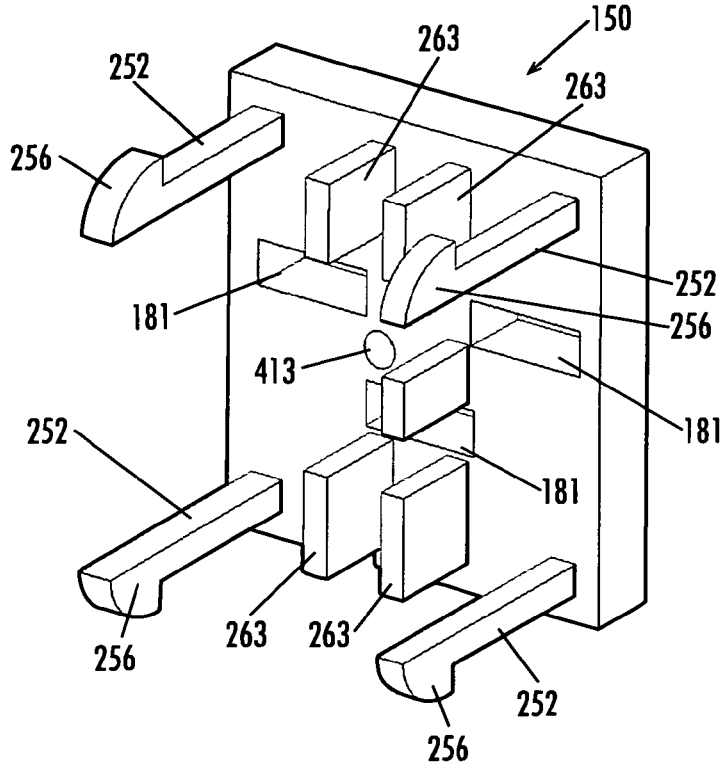
FIG. 16 shows an example embodiment of a cutaway view of a TR outlet showing a pigtail connection.
Figure 16:
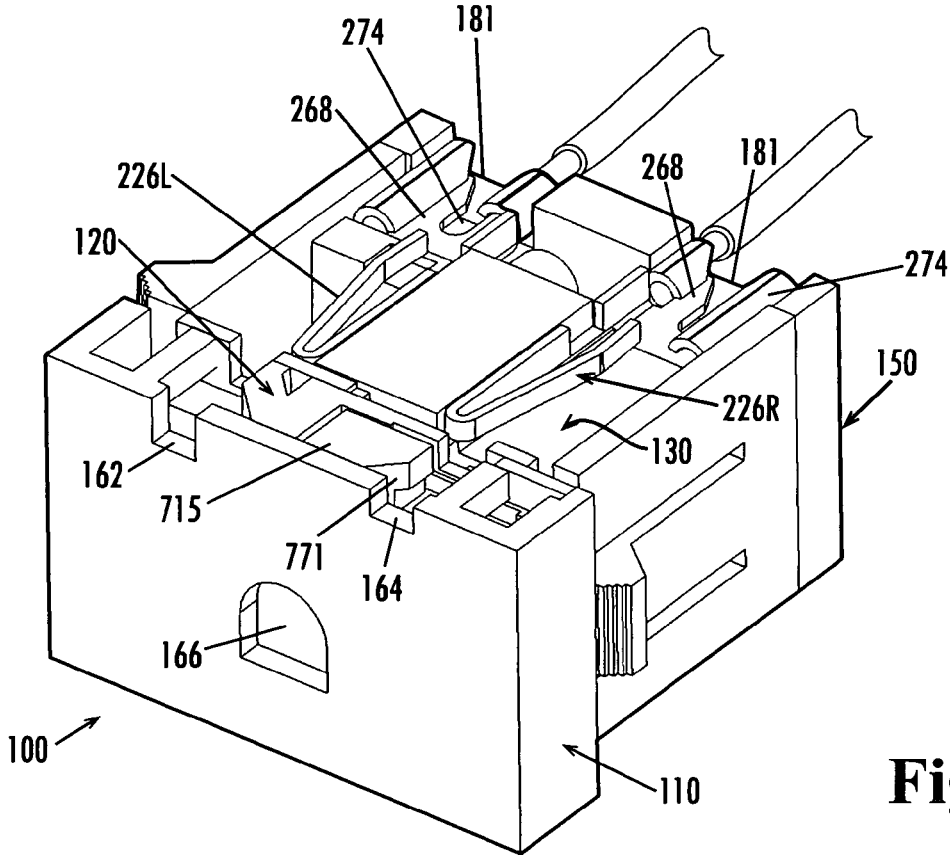

A third method of powering the convenience outlet is by a pig tail arrangement as shown in FIG. 16. A conductor 198 may be crimped onto the pig tail connectors 196 of the terminals 226 to form pigtails 402 for wiring to a power source. The pig tails could also be spot welded or soldered onto the conductor in lieu of crimpling them on. The terminals 226 may then be inserted into their respective terminal cavities 181 in the main housing 130 and the rear of the main housing 130 closed by attachment of the rear cover 150. The conductors 198 of the pigtails 402 may extend through the conductor notches 244 (FIG. 8) in the rear edges of the top 171 and bottom 173 of the main housing 130 and be connected to a power source by known means, such as coupling the pigtail conductor to existing wiring using a wire nut. By providing a means for establishing pigtail connections, the TR convenience outlet 100 can be easily assembled and wired prior to installation in a housing and may eliminate the need for an installer to access the interior of the TR outlet 100.

Figure 10:
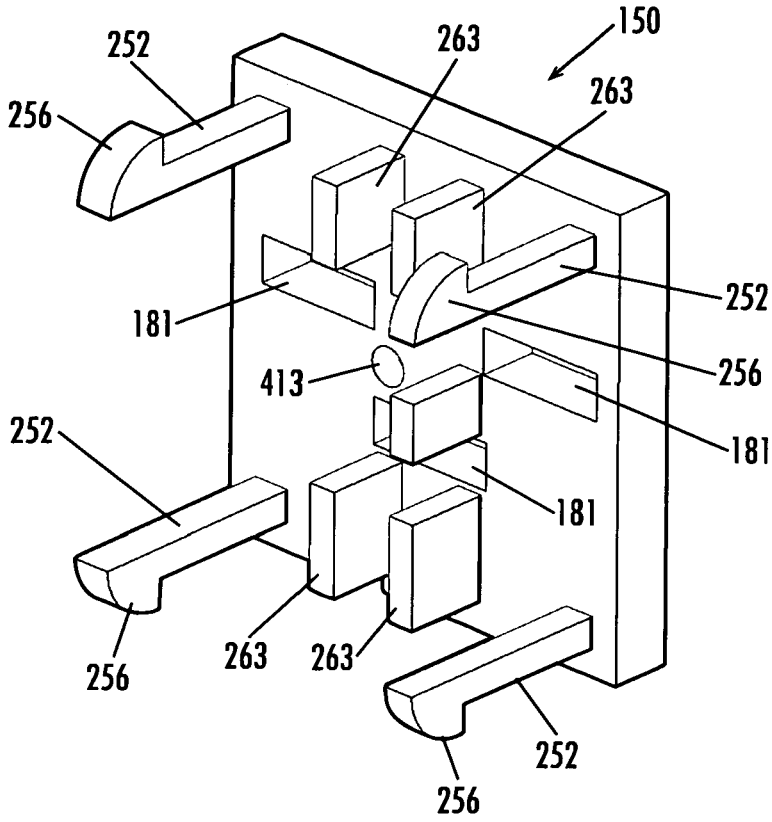
FIG. 10 shows an example embodiment of a cover of a TR outlet.

The ground pigtail 403 may be attached to a grounding blade 405 having a fastener mounting plate 407 with a fastener mounting hole 409. A threaded mount 411 may be provided at the main housing 150 that is aligned with the fastener aperture 413 in the rear cover 150 so that a fastener, such as a screw 999, can extend through the fastener mounting hole 409, fastener aperture 413, and into the mount 411 to attach the mounting plate to the rear cover 150. As best seen in FIGS. 9 and 10, the threaded mount 411 and fastener through fastener aperture 413 may be off center line of the main housing 130 and rear cover 150, respectively, to prevent interference between the screw 999 and a conductor 301 extending through the main housing 150. Although shown in the example embodiments as being wired with solid conductors 301, stranded conductors may also be used.

This fastener arrangement can be used to secure the rear cover 150 to the main housing with the wires are attached via the IDC connections, or through spade connectors, or with pigtail wires crimped or soldered onto the contacts. This provides additional securing means in addition to the engagement of the lugs 256 of the legs 252 of the rear cover 150 in the slots 199 of the main housing 130. This helps prevent the rear cover 150 from popping off the main housing 130 during wiring or installation of the TR outlet 100 in a housing.

By providing multiple wiring arrangements, the TR outlet 100 allows an installer to easily wire the TR convenience outlet 100 to new or previously installed housing. For example, an outlet 100 in an existing housing assembly can be removed and replaced by the TR convenience outlet 100, and wired to the existing wiring of the housing, whether if has spade connectors, an IDC connection, or pigtails.

As previously mentioned, the TR outlet 100 may be tamper resistant. In an example embodiment, a TR module 120 provides tamper protection by preventing contact between an object inserted through an aperture 162, 164 of the face plate 110 and a power terminal 226 unless an object is simultaneously inserted through the other aperture 162, 164. For example, the insertion of an object into a single one of the power apertures 162, 164 will not penetrate the TR module 120 and therefore will not contact a terminal 226. Only when two objects, such as the tines 182, 184 of an electrical plug 190 are simultaneously inserted through the apertures 162, 164 of the face plate 110 and engage the TR module 100 will the TR module 100 convert between a closed position to an open position and thereby allow contact with the terminals 226.

The TR module 120 may be similar to that incorporated into a wall outlet by Pass and Seymore tamper resistant receptacle part number 885TR-W and available from electrical product distributors. In an example embodiment shown in FIGS. 17 and 18, the TR module 120 may be a slide arrangement that includes major 400 and minor 402 slides which move relative to one another to move between closed and open positions to block or allow passage of an object through the TR module 120 and thereby allow or prevent electrical contact between the object and a terminal 226.

Figure 18:
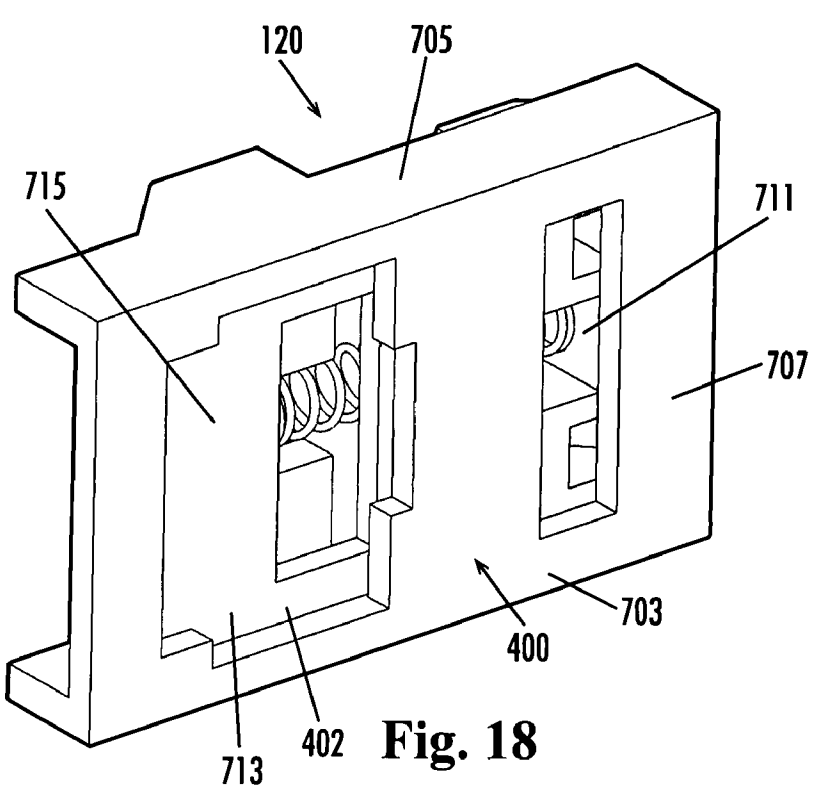
FIG. 18 shows example embodiments of a TR module.
Figure 17:
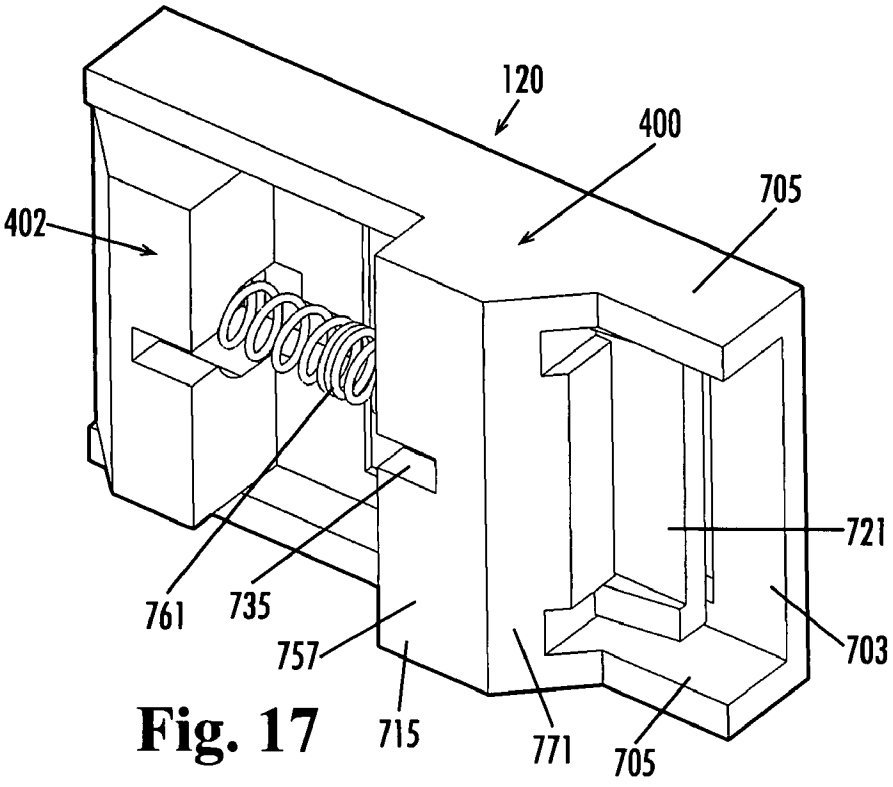
FIG. 17 shows an example embodiment of a TR assembly.
Figure 19:
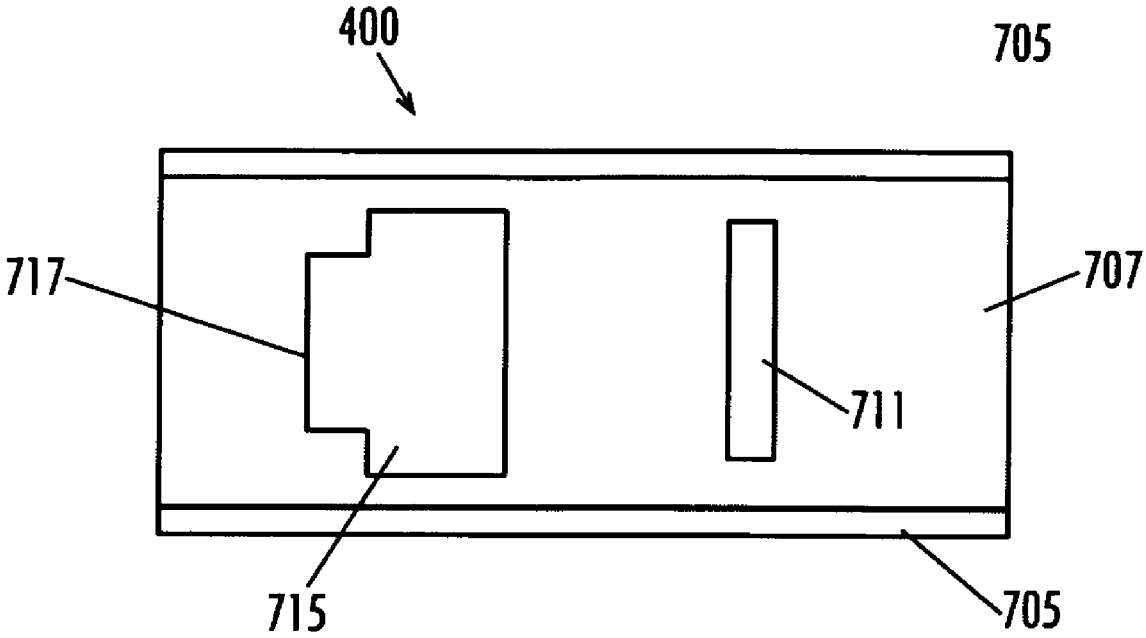
FIG. 19 shows an example embodiment of a major slide of a TR module.

As shown in FIGS. 17-19, the major slide 400 may include a generally planar rectangular-shaped body 703 having upturned edges that define sidewalls 705. A portion of the body 703 at the end defines a blocking plate 707 that extends between the sidewalls 705 and that in a default position cover a terminal 226L. A first aperture 711 may be provided adjacent the blocking plate 707, the aperture 711 defining a receiving slot adapted to allow passage of a tine 182 of a plug 190 therethrough. A second aperture 713 may also be provided. A cam 715 may extend over a portion of the second aperture 713, so that the uncovered portion of the aperture 713 defines a receiving slot 717 configured to allow passage of a tine 184 of a plug 190 therethrough. The first 711 and second 717 slots may be spaced apart to coincide with the spacing of prongs 182 of a standard electrical plug 190.

The cam 715 may include a recess 735 adapted to receive the end of a spring 761 and serve as a push wall against which the spring 761 pushes. The cam 715 may include a planar surface 757 for abutting the rear of the face plate 110 and an angled contact surface 771 that extends from the planar surface toward the body 703. The contact surface 771 may be adapted to engage an object and act as a ramp which upon continued engagement by the object forces the cam to move laterally as the object moves toward the body 703. This moves the slide 400 laterally in a direction perpendicular to the movement of the object. In the example embodiment shown in FIG. 17 the contact surface 771 is configured to move the cam 715 and the major slide 400 to the left against thereby compressing the spring 761.

Figure 20:
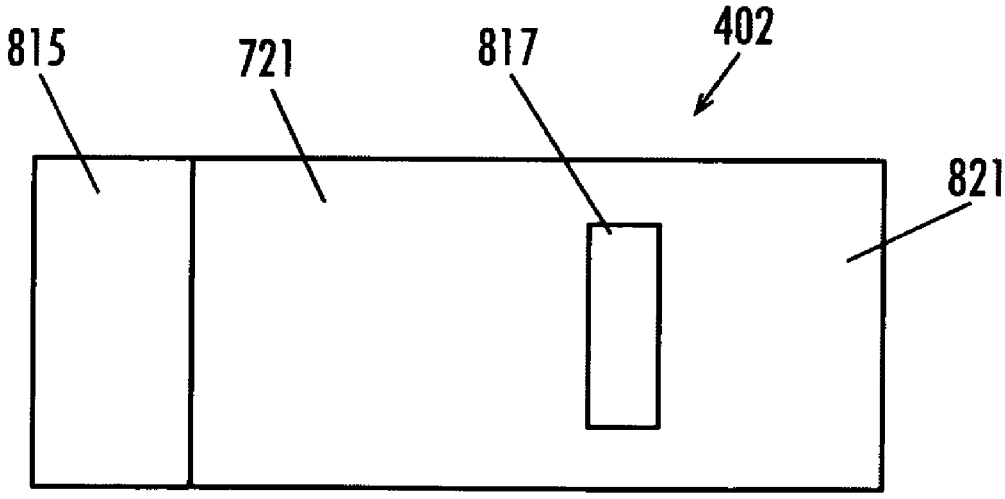
FIG. 20 shows an example embodiment of a minor slide of a TR module.

The minor slide 402 (FIG. 20) may be similar to the major slide 400 and include a generally planar rectangular-shaped body 721, having a cam 815 at one end, a slot 817 adapted to receive a tine 184 of a plug 190, and a blocking plate 821 for blocking a pathway to a terminal 226.

As shown in FIGS. 17 and 18, the major 400 and minor 402 slides are arranged to work in conjunction with one another to control access to the terminals 226 to objects inserted through the front of the TR outlet 100. In an example embodiment, the major 400 and minor 402 slides are arranged to form a layered assembly in which the two slides 400, 402 are movable relative to one another to change the TR module 100 between a closed and open condition. In the example embodiment of a TR module 120 shown in FIG. 21, the major slide 400 and minor slide 402 are arranged so that the body 721 of the minor slide 402 slides in the plane of the space between the body 703 and cam 715 of the major slide. The cams 715, 815 of the slides 400, 402 are positioned in the same plane in opposing positions so that a spring 761 extends between the cams 715, 815 to push the slides apart to their default closed position. The minor slide 402 may be sized to fit between the major slide 400 the sidewalls 705 of the major slide 400 so the body 721 of the minor slide 402 slides over the body 703 of the major slide 400. The minor slide 402 may be prevented from being expelled by the force of the spring by stops 697 provided on the minor slide 402.

Figure 5:
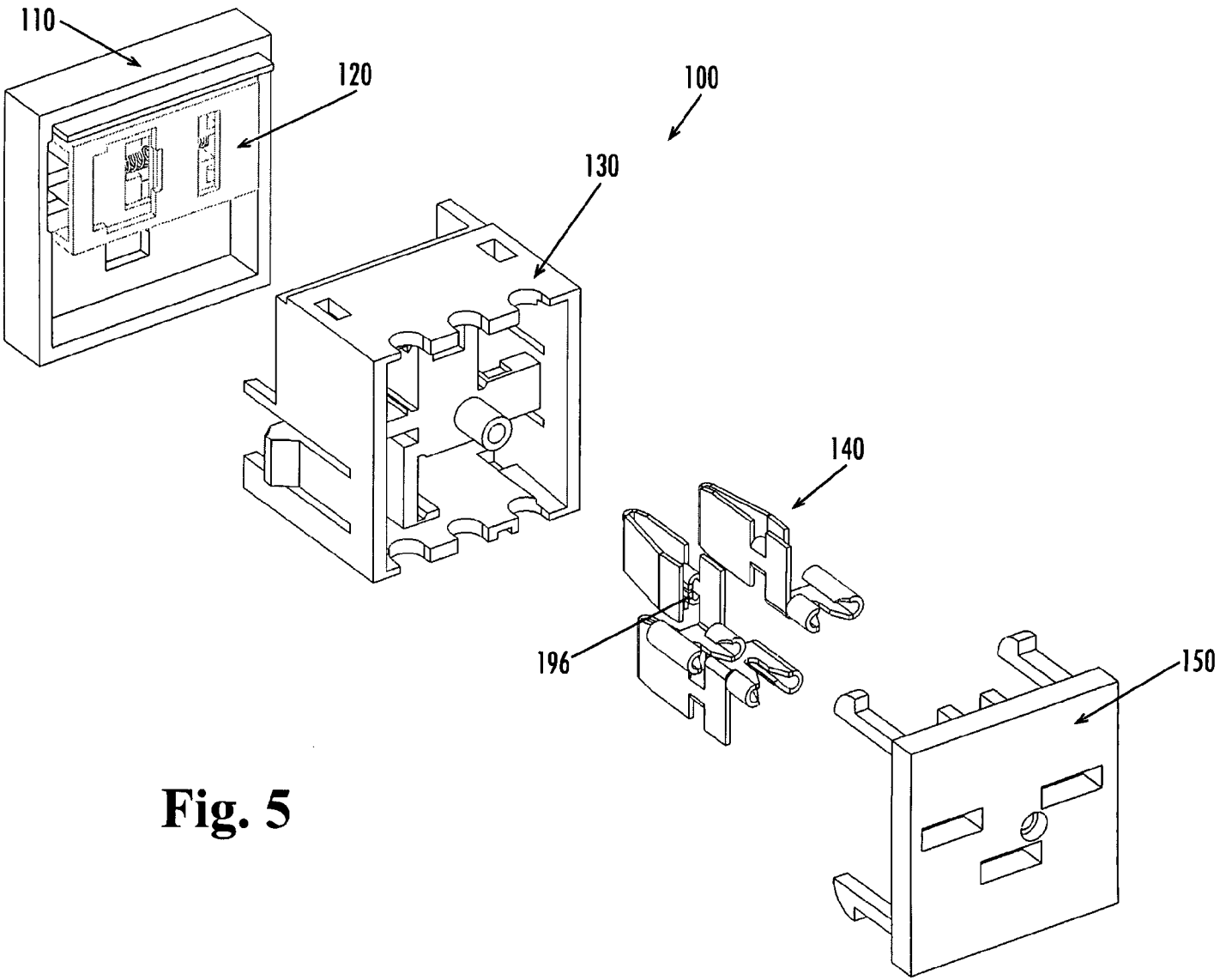
FIG. 5 shows an exploded view of an example embodiment of a tamper resistant convenience outlet.
Figure 21:
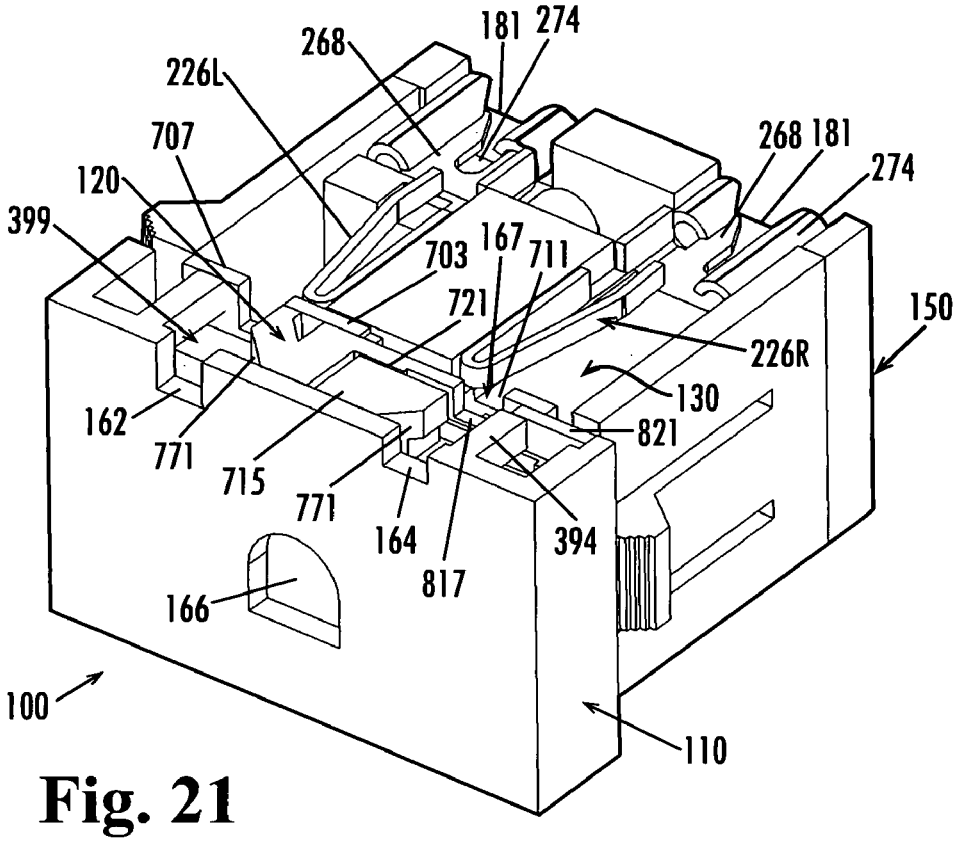
FIG. 21 shows an example embodiment of a TR outlet with the TR module in a closed condition.

As shown in FIGS. 5, 7 and 21 the faceplate 110 may be configured for housing the TR module 120 so that the TR module 120 is positioned between the apertures 162, 164 of the face plate 110 and the terminals 226 held within the main housing 130. The face plate 110 may be formed of a rigid electrical insulating material, such as a thermoplastic or a thermoset and may include plurality of support members 384 which are integrally molded therewith for strengthening the face plate 110 and providing a housing 187/386 for receiving and retaining the TR module 120.

In an example embodiment, the housing 386 may be formed by support assemblies 394 positioned on the rear of the face plate 110. The support assemblies 394 may comprise ribs 390 and posts 392 arranged adjacent to sidewalls 151 in the receiving space 155 at the rear of the faceplate 150. The space between the support assemblies 394 defines a cavity 399 for receiving the cams 715, 815 of the slides 400, 402. The cams 715, 815 are positioned in registration with the apertures 162, 164 of the faceplate 110 so that the contact surface 771 of the cams 715, 815 is positioned to engage tines 182, 184 ties of a plug 190 inserted through the apertures 162,164 of the faceplate 110. The support assemblies 394 may be sized to allow movement of the bodies 703, 721 of the slides 400, 402 over the support assemblies 394. A slot 389 may be provided for receiving the sidewalls 705 of the major slide 400. This arrangement allow the TR module 400 to be snap fit in place in the rear of the faceplate 110 as shown in FIG. 5.

For example, with the TR module 120 installed in the housing 167 in a default position, the cams 715, 815 of the slides 400, 402 are positioned in registration with an aperture 162, 164 of the face plate 110. The TR module 120 acts as a barrier between the faceplate apertures 162, 164 and the terminals 226 as an object inserted through an aperture 162, 164 must extend through the TR module 100 in order to contact a terminal 226. In the example embodiment, when in the default closed position, the major slide 400 is positioned so that the contact surface 771 of the cam 715 is aligned with one aperture 164 of the face plate 110 and the right power terminal 226R, to provide a first layer covering the right power terminal. In the default position, the minor slide 402 is positioned so that its blocking plate 821 extends behind the cam 715 of the major slide 400 to provide a second layer covering the right power terminal 226R.

Similarly, the left terminal 226L is also covered by the TR module 120 when TR module 120 is in a closed condition. For example, as shown in FIG. 21, in the closed condition, the cam 815 of the minor slide 402 may be positioned behind the left aperture 162 of the faceplate 110 to provide a first layer covering the left terminal 226L. The blocking plate 707 of the major slide 400 may be positioned behind the cam 815 of the minor slide 402 thereby providing a second layer between the aperture 162 and the terminal 226L.

As previously mentioned, a spring 761 may extend between the cams 715, 815 to urge the cams 715, 815 and their associated the slides 400, 402 to the default closed position covering the terminals. When a tine 182, 184 of a power plug 190 engages the contact surface 771 of a cam 715, 815, the associated slide 400, 402 will be moved against the force of the spring 761 to compress the spring 761 and position the move the slide 400, 402 to an open position. When the plug 190 is removed, the spring 761 forces the slides 400, 402 back into a closed position.

Figure 22:
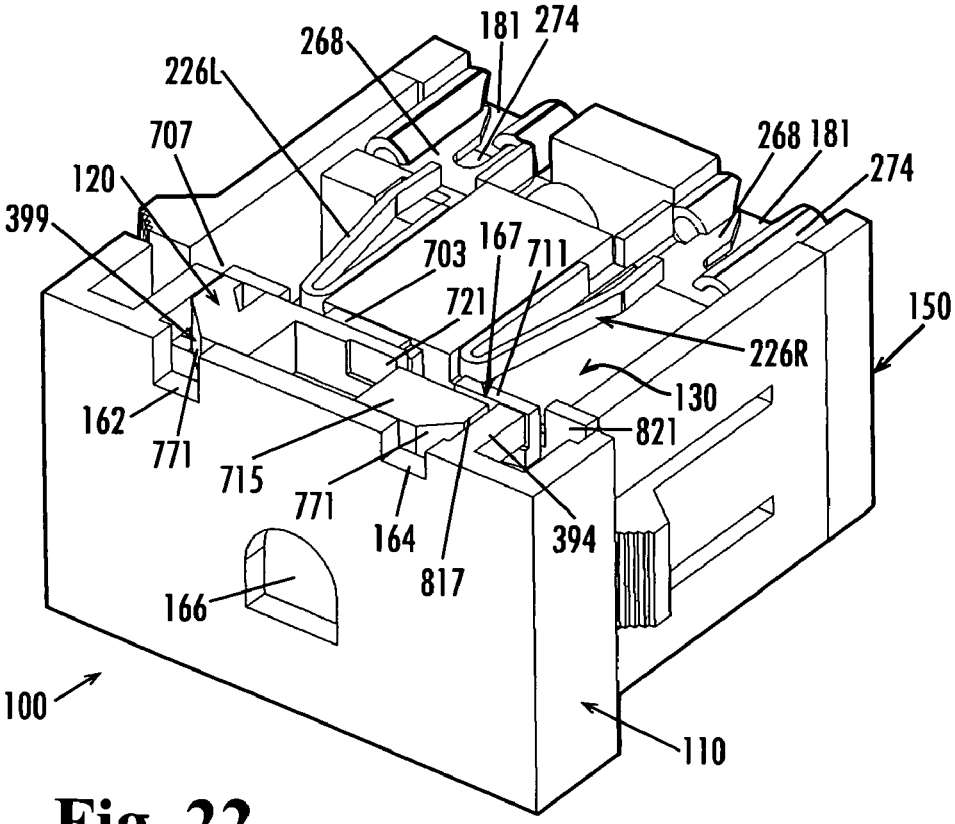
FIG. 22 shows an example embodiment of a TR outlet with the TR module in an open condition.

In the default position, the slots 711, 817 of the slides 400, 402 are not aligned and the TR module 100 serves as a barrier. Only when the major slide 400 and minor 402 both move inward toward the centerline of the TR module will the TR module convert to an open condition. For example, if a plug 190 is inserted into the faceplate 110, so that tines 182, 184 engage the cams 715, 815 of both the major 400 and minor 402 slides, then the slides 400, 402 move to an open position, thereby converting the TR module 120 to an open condition to allow the tines 182, 184 to contact the terminals 226. For example, as shown in FIG. 22, the major side 400 moves to the left and the minor slide 402 to the right so that the small slots 711, 817 of the slides 400, 402 are aligned to expose the right terminal 226R, and the large slot 713 of the major slide 400 is aligned with the left aperture 162 and left terminal 226L and the cam 815 of the minor slide 402 has been moved out of the pathway to the left terminal 226L to expose the left terminal 226L.

As previously mentioned, both slides 400, 402 must be moved to gain access to the front of the terminals 226. For example, if an object such as the end of a flathead screwdriver were inserted only through the right aperture 164 the object would engage the cam 715 of the major slide 400 and force the major slide 400 to the left to the position shown in FIG. 22 against the force of the spring 761. The path to the terminals 226 will still be obstructed however, as the blocking plate 821 of the minor slide 402 remains in its default position (as shown in FIG. 21) covering the right terminal 226R and the cam 815 of the minor slide covers the left terminal 226L. Similarly, if an object is inserted through only the left aperture 162 of the face plate 110, the object will engage the cam 815 of the minor slide 402 and force the minor slide 402 to the right as shown in FIG. 22 to align the slot 817 of the minor slide 402 with the right aperture 164 of the faceplate 110 and the right terminal 226R. There is no access to the left terminal 226L, however, as it remains covered by the blocking plate 707 of the major slide 400. There is also no access to the right terminal 226R as the cam 715 of the major slide 400 remains in its default position covering the right terminal 226R.

As mentioned above, a TR module 120 may be inserted into a housing 167 at the rear of the faceplate 110, terminals 226, 228 may be inserted to the partitions 179 of the main housing 130, and the cover 150 may be coupled to the main housing 130 by a fastener, such as a screw 999 and the lugs 256 of the rear cover legs 252. The main housing 130 may also be coupled to the faceplate 110 with the TR module 120 positioned therebetween.

As seen in FIGS. 8 and 9, the main housing 130 may have extensions 177 extending from the sides 175 and top 171 and bottom 173 of the main housing 130 that are adapted to extend within the interior space 155 of the face plate 110 and abut their inner sides. A rib 971 (FIG. 7) may extend from the top wall 153 of the faceplate 110 to engage a lip 973 extending from the top 171 of the main housing 130. The faceplate 110 and main housing 130 may be sonically welded to couple the face plate 110 and main housing 130 together with TR module 100 held within the housing 167 of the faceplate.

The compact size and adaptable wiring capabilities allows the TR outlet 100 to be incorporated into many different housing, including new and existing applications, such as under cabinet lights that are only 1" thick. With the TR outlet 100 assembled, the outlet 100 may be installed in a housing 900. For example, slots 731 may be provided in the side walls 175 of the main housing 130 to form cantilevered legs 240. The cantilevered legs 240 may have a stepped profile 734 on the free end adapted to engage with panels of various thicknesses when the convenience outlet 100 is installed in a housing, such as the housing of a plug-light assembly as described in more detail below.

Figure 23:
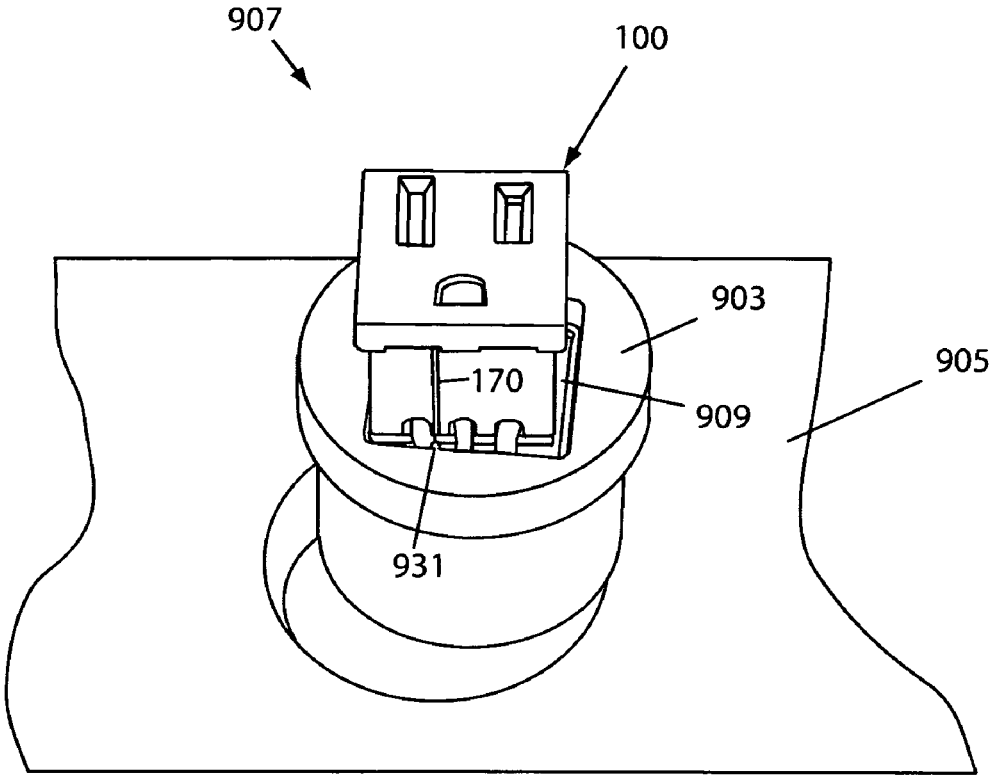
FIG. 23 shows an example embodiment of a TR outlet installed in a window sill mount.
Figure 25:
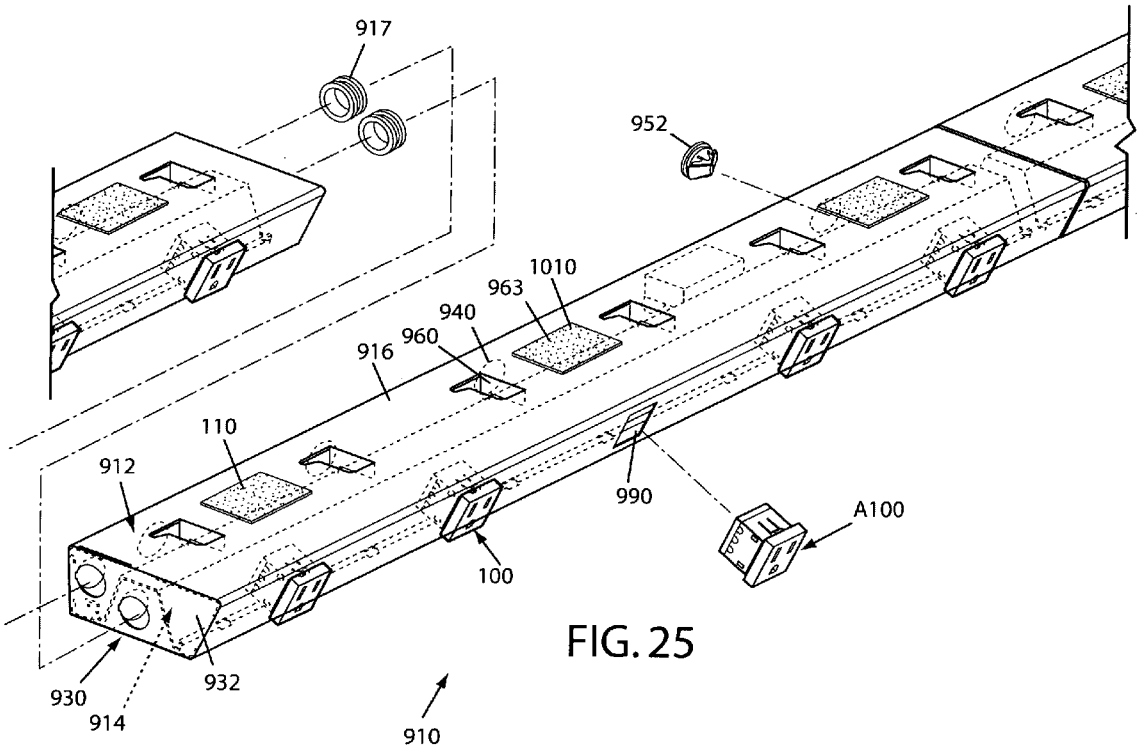
FIG. 25 shows a perspective view of a plug-light assembly in accordance with an example embodiment of the invention.

The convenience outlet 100 may be installed in a variety of different housing in a variety of different arrangements. For example, FIG. 23 shows a convenience outlet 100 installed in a window sill mount housing 903 that forms a convenience outlet assembly 907. A locator notch 170 (FIG. 2) may be provided that extends across the main housing 130 and the cover 150. The locator notch 170 allows the convenience outlet 100 to be oriented with the ground entry facing a desired direction of a four-sided square or rectangular entry 909 of the housing 903 that may be equipped with a protrusion 931 to prevent the outlet 100 from being inserted in any other direction. Because the notch 170 is inward facing, it allows the outlet 100 to replace a non-tamper resistant outlet in an existing application which may not have a protrusion 931 in the existing housing. FIG. 25 shows another example embodiment, in which a TR convenience outlet 100 is installed in the base of a lamp 913. In this case, the TR convenience outlet 100 may replace an existing non-tamper resistant outlet previously provided in the lamp 913.

Plug Light Assembly

Figure 30:
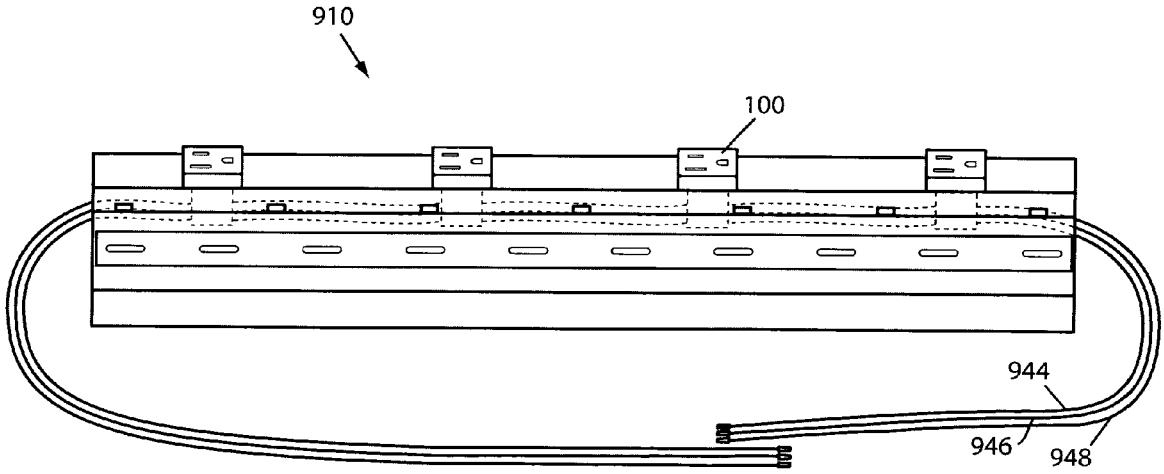
FIG. 30 shows a top view of an example embodiment of a plug-light assembly with a second wiring arrangement.

The convenience outlet may also be used to form a plug-light assembly to provide both power and light to an area. For example, another type of housing that a convenience outlet 100 may be installed in is a plug-light assembly as shown in FIG. 25. It should be noted, however, that the convenience outlet 100 may be installed in a variety of different housings and used in a variety of different contexts, such as, by way of example and not limitation, a plug strip or a window sill mount, as shown in FIG. 30 and discussed in U.S. Pat. No. 7,394,019 to Gesue. Furthermore, while in the example embodiments a plug-light assembly is shown in the context of a window sill mount and a kitchen cabinet undermount assembly, the invention is not limited thereto and may be used at other locations.

In the example embodiment shown in FIG. 1 a plug-light assembly 910 may include an outlet assembly 912 and a light assembly 914. Plugs, which may also be referred to as outlets, such as convenience outlets 100, also referred to as receptacles, may be installed in receiving apertures 990 of the outlet assembly 912.

Figure 24:
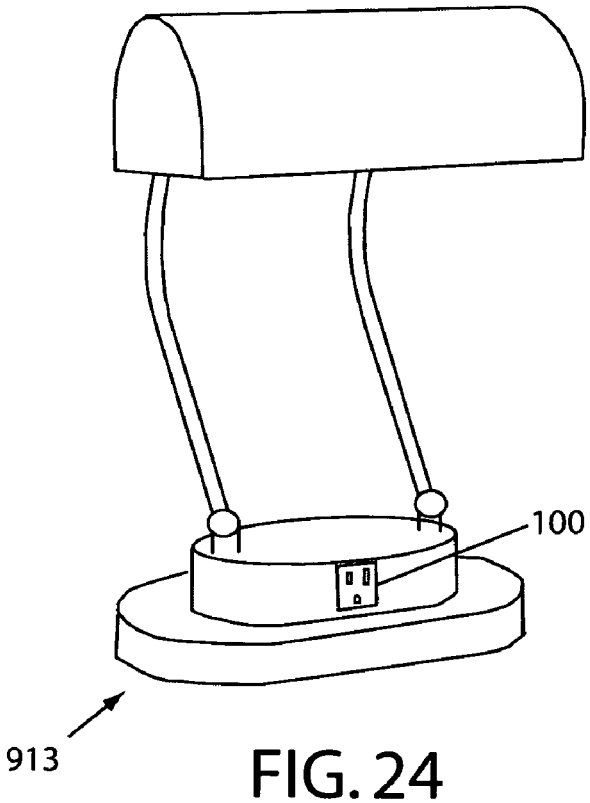
FIG. 24 shows an example embodiment of a TR outlet installed in a lamp.

As best seen in FIGS. 24 and 25, the plug light assembly 910 may be mounted beneath a cabinet 920. The outlet assembly 912 may have a plurality of outlets 100 provided at the front of the plug-light assembly 910 to provide a power source below the cabinet and the light assembly 914 may have a plurality of lights 984 to provide lighting to an area below the cabinet 920.

The outlet assembly 912 may include an outlet housing 916 comprising a generally horizontal upper base wall member 918 having front and rear ends, a vertically disposed rear wall member 922 having upper and lower ends extending downwardly from the rear end of the upper base wall member 922, a front wall 924 angled downwardly and rearwardly from the front end of the base wall member 918, and partial front 926 and rear 928 bottom wall members extending generally horizontally between the bottom ends of the front 924 and rear 922 wall members. The convenience outlets 100 may be installed in apertures 990 in the front wall 924 of the outlet housing 916. The front wall 924 may also extend straight down and the convenience outlets mounted in the front wall to face directly frontward or in the bottom wall to face directly downward.

As mentioned above, the convenience outlets 100 may have a locator notch 170 configured to receive a protrusion 931 provided at the aperture 990 to ensure a desired orientation of the convenience outlet 100 within the plug-light assembly 910. For example, it may be desirable to arrange the outlets 100 in a particular orientation depending upon the particular wiring method to be used. The outlets 100 in FIG. 25 are installed in an "upright" position and in a "side position" in FIG. 29. As seen in FIG. 25 a plurality of spaced apart outlets 100 maybe positioned in the front wall 924 of the outlet housing 916 and oriented for interconnection using an IDC wiring method. The front wall 924 of the outlet housing 916 be angled inward and the convenience outlets 100 installed within the front wall 924 so as to angle to allow easy access when the assembly is mounted under cabinet 920.

The internal ends of the front 926 and rear 928 bottom wall members may be upturned to form upwardly extending flanges 934 for engagement with a housing 942 of the light assembly 914 as explained in more detail below. The space between the bottom wall members 926, 928 defining a receiving area 938 for receiving the light assembly 914.

The internal ends of the front 926 and rear 928 bottom wall members may be upturned to form upwardly extending flanges 934 for engagement with a housing 942 of the light assembly 914 as explained in more detail below. The space between the bottom wall members 926, 928 defining a receiving area 938 for receiving the light assembly 914.

Figure 26:
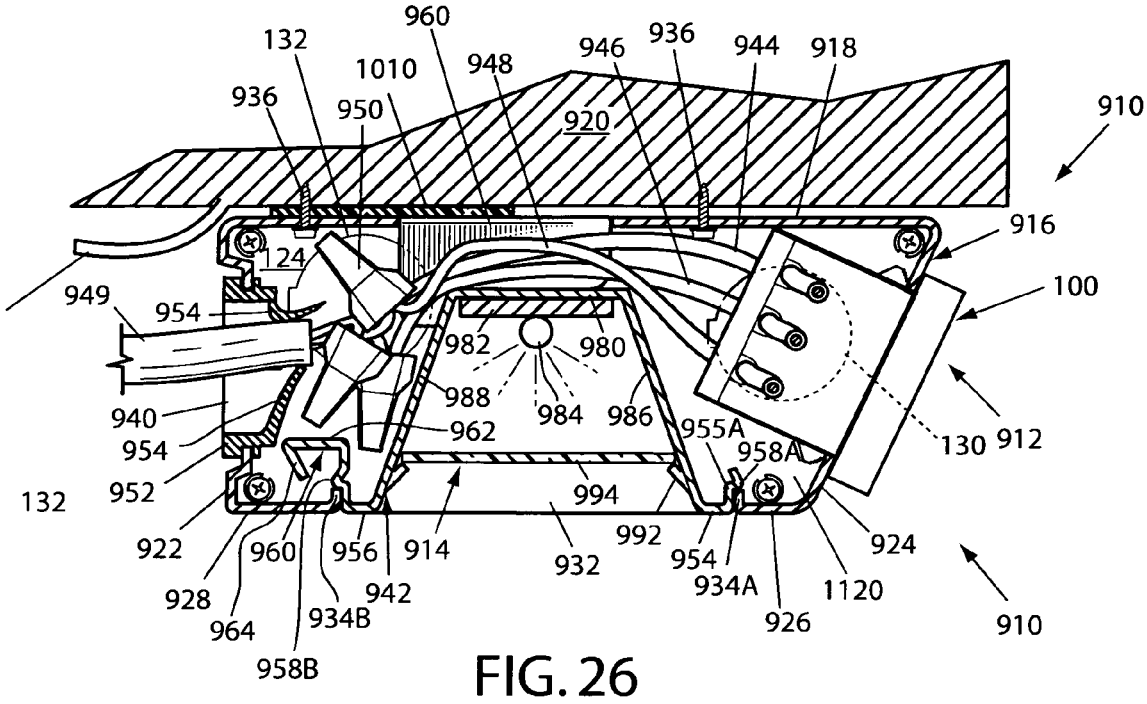
FIG. 26 shows a sectional of the sideview of the plug-light assembly of FIG. 25 along cut line 24-24 of FIG. 25 with wiring installed in accordance with an example embodiment of the invention.

The rear wall 922 of the outlet housing 916 may include one or more apertures 940 for receiving external wiring, such as wires 949, that may be electrically connected to a power source (not shown). As seen in FIGS. 25 and 26, a receiving plug 952 or bushing may be provided in the rear apertures 940. The receiving plugs 952 may have resilient fingers 954 that allow the external wires 949 to extend through the aperture 940 but grip the wires and provide strain relief to help prevent accidental withdrawal of the wires.

Apertures 940 may be provided in the rear wall 922 of the outlet housing 916 to allow entry of external wiring 949, which may be connected to a power source (not shown), into the interior of the outlet housing 916, and the connection of the external wires 949 with internal wires, 944, 946, 948 pre-wired to the outlets 100. As discussed in more detail below, apertures in the rear wall 922 may also be used to allow entry of external wiring and the connection of the external wiring to the internal wiring of the light assembly 914.

With the outlet housing 916 mounted to the undersurface of the cabinet 920, an installer may pull the external wires 949 through the receiving plug 952. The external wires 949 may be electrically connected with the internal wires 944, 946, 948 as shown in FIG. 26. For example, connectors, such as wirenuts 950, may be used to fasten the wiring together. The interior space 938 provides an installer with sufficient space to easily wire the outlets 100 to a power source. As explained in more detail below, the light assembly 914 may be moved between an installed position and an open position to allow access to the interior of the outlet assembly 912.

The light assembly 914 may include a housing 942 having a base 980, upon which a socket 982 is mounted. A bulb 984 may be installed in the socket 982. The light assembly housing 942 may include angled and outwardly extending front 986 and rear 988 wall members that extend from the front and rear ends of the base 980. A pair of supports, such as protrusions 990, may be provided on the inner surface of the front 986 and rear 988 wall members upon which a cover 992 may be placed. The cover 992 may be transparent or semi-transparent to allow light emitted from the bulb 984 to be transmitted through the cover 992 onto a counter below. The inner surfaces of the wall members 986, 988 may be reflective to further direct light through the cover 992.

The lighting assembly 914 may be removably attachable to the outlet assembly 912. For example, the light assembly housing 942 may be snap fit within the interior space 938 of the outlet assembly 912. In the embodiment shown in FIGS. 24-26, the ends of the front and rear walls of the light assembly housing may be snap-fitted to the front and rear bottom walls of the plug housing.

Figure 27:
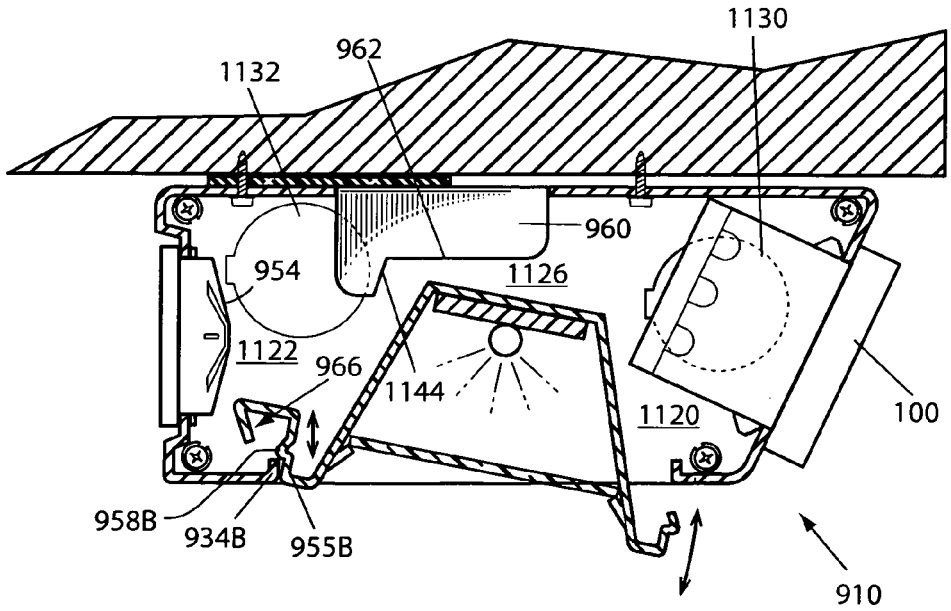
FIG. 27 shows a sectional view of the plug-light assembly of FIG. 1 along cut line 25-25 without the wiring installed.
Figure 28:
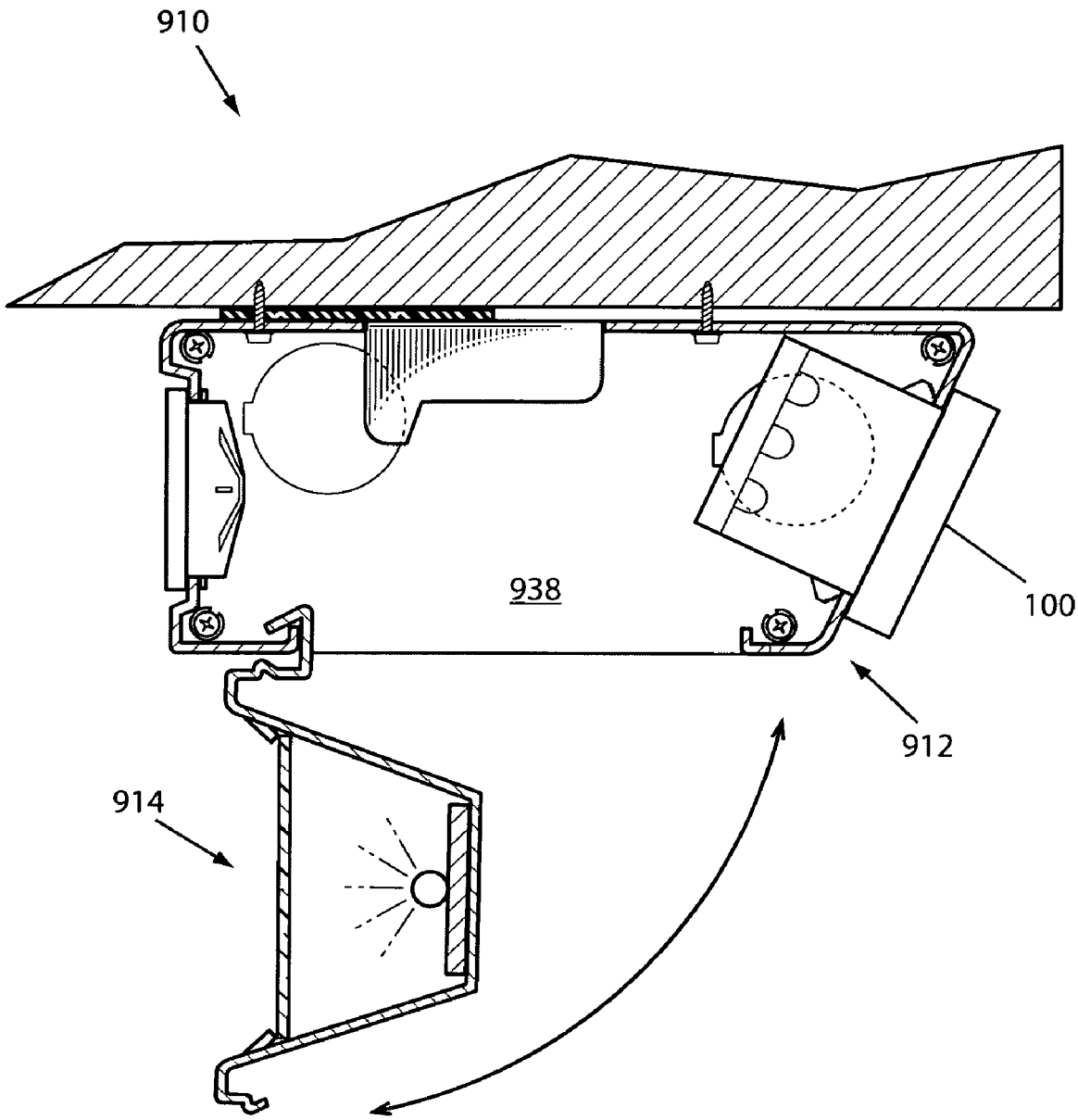
FIG. 28 shows the plug-light assembly of FIG. 27 with the light assembly in a pivoted position.

The light assembly housing 942 may have releasable locking means for releasably engaging the outlet assembly housing 916. In one example embodiment, the ends of the front and rear walls of the light assembly housing may be snap-fitted to the front and rear bottom walls of the outlet housing. As seen in FIG. 26, the lighting assembly 914 can be installed in the outlet assembly 912. The lower end of the light assembly housing 942 may include front 954 and rear 956 bottom walls that engage the front and rear bottom members of the outlet housing 916 and have upturned ends 955 that form shoulders 958. The shoulders 958 may be configured to engage the top of the flanges 934 so that the light housing 942 may be snap-fit to the outlet housing 916 with the shoulders 958 positioned over the upturned ends 934. An angled extension may extend from the shoulder 958 of the rear bottom walls to define a hanger 960 that may be used to temporarily hang the lighting assembly 914 from the outlet assembly 912 as shown in FIG. 27-26. For example, the hanger 960 may include a generally horizontal portion 962 and an angled tab 964 attached at a bend 966 so that the tab 964 angles downward and inward to define a recess 968. As shown in FIG. 28, the light assembly 914 can thereby be temporarily hung on the outlet housing 916 with the hangar 960 hanging on the upturned end 934 of the rear housing wall 928. This allows access to the interior of the interior receiving area 938. An installer can thereby move the light assembly 914 between an installed position shown in FIG. 26 to a hanging position shown in FIG. 28 as necessary to allow access to the interior of the outlet assembly 912.

Thus, the light assembly 914 may be pivoted from the outlet assembly to allow for the convenient wiring of the light assembly. For example, the front and rear walls of the light housing 942 can be tilted so that the rear of the light housing 942 is positioned so that shoulder 958 of the rear wall member 988 is positioned above the flange 934B of the rear bottom wall 928 of the outlet housing 916. From the hanging position shown in FIG. 28, the light assembly 914 may be rotated about the rear shoulder 958B so that the front shoulder 958A moves past the front flange 934A to effect a snap-in connection therebetween as shown in FIG. 26, with the shoulders 958A-B positioned above the flanges 934A-B and the upturned ends 955A-B pushing against the flanges 934A-B. The shoulders 958A-B releasably prevent the disconnection of the upper end of the outer wall member 960 from the connector shoulder 952.

Figure 29:
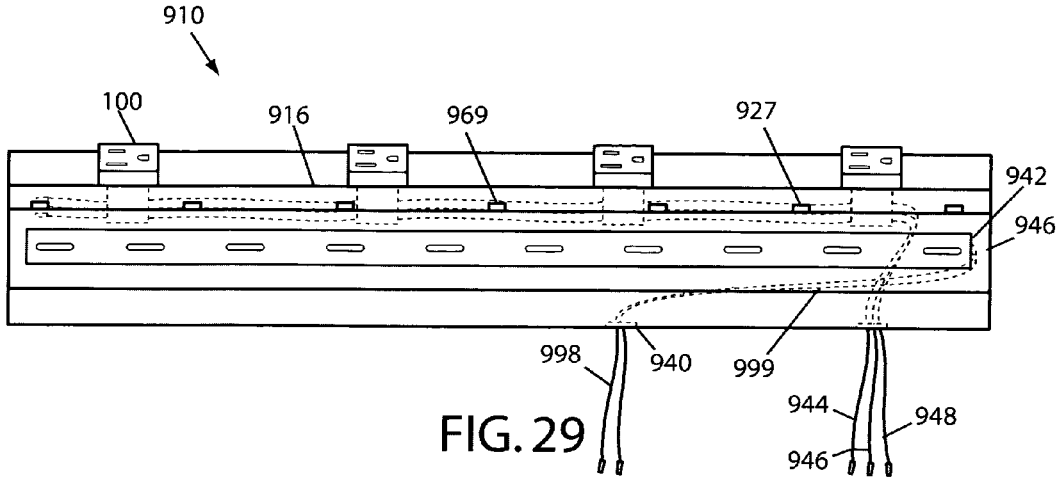
FIG. 29 shows a top view an example embodiment of a plug-light assembly with a first wiring arrangement.

The light assembly 914 may be disengaged from the outlet plug assembly 912 by inserting a flat head screw driver or similar device between 955A and 934A to pry them apart. The light assembly 914 may then be swung downward to an access position as shown in FIG. 26 or removed from the outlet plug assembly 914 if desired. As shown in FIG. 29, slots 969 may also be provided in the outlet assembly housing 916 that are configured to receive a blade of a flat-headed screwdriver to pry the light assembly housing 942 from the housing of the outlet assembly housing 916. The slots 969 also allow for air circulation to cool the light assembly 914 and extend component life. In alternate embodiments, additional apertures may be provided.

With the light assembly 914 installed in the plug assembly 912 as shown in FIG. 26, the front 986 and bottom 954 walls of the light housing 942, together with the front 924 and bottom 926 walls of the outlet housing 916 define a front trough 1120 or raceway for the internal wiring 944, 946, 948 of the outlets 100. For example, an IDC connection may be made between outlets 100 installed in the outlet assembly 912 and the wires routed along the front trough 1120. Similarly, the rear 988 and bottom rear 954 walls of the light housing 942, together with the rear 922 and bottom rear 928 walls of the outlet housing 916 define a rear trough 1122 that provides space for the connection of the external wiring 949 the internal wiring 944, 946, 948 of the outlet assembly 912 and light assembly 914. In addition, the space between the base 918 of the outlet assembly housing 916 and the base 980 of the light assembly housing 942 defines a passageway 1126 to extend between the front 1120 and rear 1122 troughs.

In one method of installation, convenience outlets 100 may be installed in the receiving apertures 990 of the front wall 924 of the outlet assembly housing and electrically connected using to the external wiring 949 at the rear trough 1122. For example, as discussed above, an IDC connection may be used to interconnect the convenience outlets 100 and the ends of the wires 944, 946, 948 placed in the rear trough 1122. The ends of the internal wires 944, 946, 948 may then be connected to the ends of the external wires 949 in the rear trough 1122. The internal 944, 946, 948 and external 949 wires may also be connected prior to insertion of the light assembly 914 if desired. The internal wires 944, 946, 948 may extend over the light assembly 914 through the passageway 1126 defined between the base 980 of the light housing 914 and the base 918 of the outlet assembly housing 916. As seen in FIG. 30, the internal wires 999 of the light assembly 914 may extend out the end of the light assembly 914 and be routed to the rear wire trough 1122 for connection with external low voltage wiring. As discussed above, the light assembly 914 may be wired when in an open hanging position and the light assembly 914 then swung to a closed position. Thus, the wiring at the rear trough 1122 is easily accessible prior to installation of the light assembly due to the easy access through the receiving area 938 of the outlet assembly 912. In addition, an installer can partially install the light assembly 914 into the outlet assembly housing 916 and access the external wiring 949 to electrically connect the internal wiring 999 of the light assembly 914. The light assembly 914 can then be swung into the installed position.

As mentioned above, apertures 940 or knockouts may be provided in the rear wall 922 of the outlet assembly housing 916 to allow for entry of external wires 949 that may be electrically connected with the internal wiring 944, 946, 948 of the outlet assembly 912 or the light assembly 914. For example, multiple rear apertures 940 may be provided to allow the outlet assembly 912 and light assembly 914 to be wired separately. For example, the outlets 100 of the outlet assembly 912 may be configured to be fed with a first circuit to power the outlets 100 and the light assembly 914 configured to power the lights 984 with a second circuit. In one example embodiment, external wires 949 from a first circuit may be electrically connected to the internal wires 944, 946, 948 of the outlet assembly 912 and external wires (not shown) from a second circuit may be electrically connected to the internal wires 999 of the light assembly 914. This allows the outlets 100 to deliver the desired current required to meet electrical codes while still providing power to the lights 984. Furthermore, the lights 984 may be manipulated, such as being turned on, off, or dimmed via a switch or dimmer integral to the plug light assembly (not shown), or mounted remotely from the assembly to control the circuit prior to its entry into the assembly, without affecting the power to the outlets 100. This separate circuit arrangement thus allows the outlets 100 to deliver the desired amps, such as 15 or 20 amps, as required by the applicable electrical codes and the lights 984 to be manipulated, without affecting the power to the receptacles. A switch (not shown) such as a dimmer switch may be integrated with the light assembly housing 942 or controlled remotely using a remote device (not shown). Low voltage wiring 998 shown in FIG. 29 may also be routed through an aperture 940 in the rear wall 922 and connected with internal wiring 999 of the light assembly 942.

End caps 932 may be positioned over the ends of the outlet housing 916. Apertures 130, 132 or knockouts 131, 133 may be provided in the end caps 932 to allow the extension of wiring through the ends of the outlet assembly housing 916. Wiring may thus be extended between adjacent plug-light assemblies 910 if desired. The knockouts 131, 133 in the end caps 932 allow a strain relief to be added in the field to secure the incoming wires to the housing via a screw or other mechanical fastener. For example, a strain relief may be configured to resist a 25-pound pull test. For example, the knock outs 131, 133 may also be removed and a bushing 917 inserted in the resulting apertures 130,132 to allow wiring to be routed between plug-light assemblies 910. For example, the outlet wiring 944, 946, 948 may be routed through a first aperture 130 and the internal light assembly wiring 999 through a second aperture 132 in the end caps 932.

Having apertures 940, 130, 132 in both the rear and the ends of the plug-light assembly 910 provides the ability to feed power at either end of the plug-light 910 assembly through the front trough 1120 and apertures 130, 132 in the end caps 932 or through apertures 940 in the rear of the outlet assembly housing 912. Loose wires from the outlets 100 may be routed through one or both ends of the outlet assembly housing 912 through the end caps 932 as the wiring is routed along the front trough 1120. An installer can cut the wires to an appropriate length for connection with external wiring. Ground Fault Interruption (GFI) circuitry (not shown) may also be incorporated into the fixture, in-line with the convenience outlets 100, to eliminate the need for the circuit to the convenience outlets to come from a GFI circuit breaker or GFI receptacle.

A spacer 1010 (FIGS. 23 and 24) may be provided at the top of the plug-light assembly 910 between the base wall 918 of the outlet assembly 912 and the cabinet 920. Coupling means, such as an adhesive 963, hook-and-loop fasteners, or the like, may be added to the spacers 1010 to allow for attachment of the plug-light assembly 910 to the underside of a cabinet 920 and position the plug-light assembly for more permanent connection with fasteners, such as screws 936 shown in FIGS. 24 and 25.

A bracket 960 may extend from the base 918 of the outlet housing 916 into the interior space 938. The bracket 960 may be shaped so that a generally horizontal end 962 abuts the base 980 of the light assembly housing 942 and an angled portion 1144 abuts an upper portion of the rear wall 988 of the light housing 942. The bracket 960 may be formed by punching out a portion of the base 918 of the outlet housing 916. The aperture left by the punch out may allow for air circulation within the plug light assembly 910.

The outlet housing 916 and the light assembly housing 942 may be made of sheet of metal, such as aluminum material and bent and punched to the desired shape; or molded or extruded from aluminum or plastic. The lighting assembly housing 942 may be of sufficient resilience to allow for the snap-fit arrangement discussed above.

The plug-light assembly 910 may also be configured to allow for the adjustment of its length in the field. For example, the plug light assembly 910 may be shortened to a desired length by trimming the outlet assembly 912 and the light assembly 914 and associated wiring if needed. This allows for the customization for a particular counter or cabinet configuration. The wires for the outlets 100 may be cut and capped at an end opposite of the feed wires. The plug-light assembly 910 may also be coupled to other assemblies to form an assembly of a desired length. For example, an end cap 932 at an end of the plug-light assembly 910 may be removed and replaced with a coupling section (not shown) to allow the ends of adjacent plug-light assemblies 910 to be coupled together. The internal wiring 944, 946, 948 for the outlets 100 of a first outlet assembly 912 may then be connected to the internal wires 944, 946, 948 of an adjacent plug-light assembly 910. Similarly, the internal wiring 999 of the first light assembly 914 may be electrically connected to the internal wiring 999 of an adjacent light assembly 914. The light assembly housing 914 may be made of metal, such as aluminum or steel, or made of plastic to eliminate the need to ground the light assembly housing 942. Furthermore, the outlet housing 916 may be sized of a greater length than the light assembly housing 942 so as to provide a gap 946 therebetween near the end. This allows for the routing of the internal wires 999 out of an end of the light assembly 914 to a rear aperture 940.

A variety of different light sources may be used such as LED, incandescent, halogen, or fluorescent and powered with line or low voltage power. If low voltage is used the transformer, ballast (for fluorescent lamps), or the driver (for DC LED lamps) (not shown) may be incorporated inside of the housing or mounted in a remote location, such as within the kitchen cabinet. A diffuser lens may be provided. The LED or other light source can be easily replaced by simply replacing the light assembly and eliminating the need to replace and re-wire the outlet assembly.

The above-described and illustrated embodiments of the present invention are merely exemplary examples of implementations set forth for a clear understanding of the principles of the invention. Variations and modifications may be made to the above-described embodiments, and the embodiments may be combined, without departing from the scope of the following claims. Directional references used herein, such as "top", "bottom", "end", "side," "left", "right", "front" and "rear," are used for convenience in reference to the drawings and are not meant to limit the invention to the particular orientation or arrangements of the example embodiments.

What is claimed is:

1. An apparatus, comprising:

a housing;

a face plate at the front of the housing configured to receive a tine of an electrical plug;

a terminal assembly within the housing, said terminal assembly including a plurality of terminals configured to engage a conductor, wherein said plurality of terminals is configured for an insulation displacement connection (IDC), a spade connection, and a pigtail connection;

a tamper-resistant (TR) module enclosed within the housing between the faceplate and the terminal assembly, wherein the housing is configured to install within an outlet assembly housing.

2. The apparatus of claim 1, further comprising pigtails electrically connected to at least one terminal of said plurality of terminals.

3. The apparatus of claim 1, wherein said housing further comprises a notch configured to receive a protrusion provided on an aperture of an outlet assembly housing.

4. The apparatus of claim 1, wherein said plurality of terminals comprises a spade connector.

5. The apparatus of claim 1, further comprising an outlet assembly housing configured to receive the housing.

6. The apparatus of claim 1, wherein said faceplate includes a housing recess for receiving said TR module.

7. The apparatus of claim 1, wherein said apparatus has a length of one inch or less to allow for insertion in existing convenience outlet housings.

8. The apparatus of claim 1, wherein a footprint of the housing is sized to a standard convenience outlet housing opening.

9. The apparatus of claim 1, further comprising a back cover.

10. The apparatus of claim 9, further comprising a fastener mount provided in the back cover, the fastener mount offset from the pathway of a plurality of conductors to allow the entry of a fastener without contacting the conductors.

11. The apparatus of claim 9, wherein said back cover is configured to receive spade connectors through an aperture in the back cover.

12. The apparatus of claim 9, wherein said rear cover has an aperture to receive a fastener.

13. The apparatus of claim 12, wherein said aperture is arranged off center.

14. An apparatus, comprising:

a housing;

a face plate at the front of the housing configured to receive a tine of an electrical plug;

a terminal assembly within the housing, said terminal assembly including a plurality of terminals configured to engage a conductor;

a tamper-resistant (TR) module enclosed within the housing between the faceplate and the terminal assembly; and wherein the housing is configured to install within an outlet assembly housing and the housing has an inlet on a first side of the housing configured for the entry of an insulated into the housing and an outlet on a second side of the housing for the exit of the insulated conductor so that the insulated conductor extends through the housing.

15. The apparatus of claim 14, wherein said terminal is configured for an IDC connection, a spade connection, and a pig tail connection.

16. The apparatus of claim 14, wherein said terminal assembly is configured to establish an IDC connection with the insulated conductor.

17. The apparatus of claim 14, further comprising:

a back cover having an aperture configured to receive a spade connector terminal assembly is configured to establish an IDC connection with the insulated conductor and a spade connection with the spade connector.

18. The apparatus of claim 14, further comprising:

a back cover having an aperture configured to receive a spade connector and an aperture to receive a pigtail, wherein the terminal assembly is configured to establish an IDC connection with the insulated conductor, a spade connection with the spade connector, and a pigtail connection with the pigtail.

19. An apparatus, comprising:

a housing;

a face plate at the front of the housing configured to receive a tine of an electrical plug;

a terminal assembly within the housing, said terminal assembly including a plurality of terminals configured to engage a conductor;

a tamper-resistant (TR) module enclosed within the housing between the faceplate and the terminal assembly; and wherein the housing is configured to install within an outlet assembly housing and the housing has an inlet on a first side of the housing configured for the entry of an insulated into the housing and an outlet on a second side of the housing for the exit of the insulated conductor so that the insulated conductor extends through the housing.

* * * * *